US009678460B2

(12) United States Patent
Hase et al.

(10) Patent No.: US 9,678,460 B2
(45) Date of Patent: Jun. 13, 2017

(54) FIXING DEVICE, IMAGE FORMING APPARATUS, AND FIXING METHOD

(71) Applicants: Takamasa Hase, Tokyo (JP); Susumu Matsusaka, Kanagawa (JP); Yasuhiko Ogino, Kanagawa (JP); Shohta Kobashigawa, Tokyo (JP); Kenji Ishii, Kanagawa (JP); Kazuhito Kishi, Kanagawa (JP); Takashi Seto, Kanagawa (JP); Hiroshi Seo, Kanagawa (JP); Ippei Fujimoto, Kanagawa (JP); Hiroshi Yoshinaga, Chiba (JP); Hiromasa Takagi, Tokyo (JP); Kazunari Sawada, Tokyo (JP)

(72) Inventors: Takamasa Hase, Tokyo (JP); Susumu Matsusaka, Kanagawa (JP); Yasuhiko Ogino, Kanagawa (JP); Shohta Kobashigawa, Tokyo (JP); Kenji Ishii, Kanagawa (JP); Kazuhito Kishi, Kanagawa (JP); Takashi Seto, Kanagawa (JP); Hiroshi Seo, Kanagawa (JP); Ippei Fujimoto, Kanagawa (JP); Hiroshi Yoshinaga, Chiba (JP); Hiromasa Takagi, Tokyo (JP); Kazunari Sawada, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/063,769

(22) Filed: Mar. 8, 2016

(65) Prior Publication Data

US 2016/0274510 A1 Sep. 22, 2016

(30) Foreign Application Priority Data

Mar. 19, 2015 (JP) ..... 2015-055959
Feb. 5, 2016 (JP) ..... 2016-021104

(51) Int. Cl.
*G03G 15/20* (2006.01)

(52) U.S. Cl.
CPC ..... *G03G 15/2039* (2013.01); *G03G 15/2042* (2013.01); *G03G 15/2082* (2013.01);
(Continued)

(58) Field of Classification Search
CPC ..... G03G 15/2039; G03G 15/2042; G03G 15/2082; G03G 15/2053; G03G 2215/0132; G03G 2215/2035
(Continued)

(56) References Cited

U.S. PATENT DOCUMENTS 5,862,436 A * 1/1999 Ishizawa ..... G03G 15/2042 219/216
8,774,666 B2 * 7/2014 Saito ..... G03G 15/2042 399/334
(Continued)

FOREIGN PATENT DOCUMENTS

JP 2002-311735 10/2002
JP 2009-092887 4/2009
(Continued)

*Primary Examiner* — Sophia S Chen
(74) *Attorney, Agent, or Firm* — Oblon, McClelland, Maier & Neustadt, L.L.P.

(57) ABSTRACT

A fixing device includes a primary heater, a secondary heater, and a tertiary heater to heat a primary heating span, a secondary heating span, and a tertiary heating span of a fixing rotator, respectively. A primary temperature detector and a secondary temperature detector detect a temperature of the fixing rotator. A tertiary temperature detector detects a temperature of a pressure rotator. A controller selectively performs a primary control mode to de-energize the tertiary heater and a secondary control mode to connect the secondary heater and the tertiary heater in series to energize the primary heater, the secondary heater, and the tertiary heater. The controller energizes the secondary heater and the tertiary heater in the secondary control mode based on the temperature of the fixing rotator and the pressure rotator detected by the secondary temperature detector and the tertiary temperature detector, respectively.

20 Claims, 12 Drawing Sheets

(52) U.S. Cl.
CPC ..... *G03G 2215/0132* (2013.01); *G03G 2215/2035* (2013.01)

(58) Field of Classification Search
USPC ..... 399/69, 334, 45
See application file for complete search history.

(56) References Cited

U.S. PATENT DOCUMENTS

| | | | | |
|---|---|---|---|---|
| 8,909,084 | B2 * | 12/2014 | Fujii | G03G 15/2042 399/334 X |
| 2009/0285592 | A1 * | 11/2009 | Nakatani | G03G 15/2039 399/334 X |
| 2011/0200368 | A1 | 8/2011 | Yamaguchi et al. | |
| 2013/0164059 | A1 | 6/2013 | Takagi et al. | |
| 2013/0170879 | A1 | 7/2013 | Yoshinaga et al. | |
| 2013/0183070 | A1 | 7/2013 | Kawata et al. | |
| 2013/0183071 | A1 | 7/2013 | Iwaya et al. | |
| 2015/0037052 | A1 * | 2/2015 | Muramatsu | G03G 15/2042 399/45 |
| 2015/0063884 | A1 | 3/2015 | Iwaya et al. | |
| 2015/0331376 | A1 * | 11/2015 | Shimmura | G03G 15/2042 399/69 |
| 2016/0187823 | A1 * | 6/2016 | Seto | G03G 15/2082 399/329 |

FOREIGN PATENT DOCUMENTS

| | | |
|---|---|---|
| JP | 2011-164462 | 8/2011 |
| JP | 2014-178370 | 9/2014 |

* cited by examiner

FIXING DEVICE, IMAGE FORMING APPARATUS, AND FIXING METHOD

CROSS-REFERENCE TO RELATED APPLICATIONS

This patent application is based on and claims priority pursuant to 35 U.S.C. §119 to Japanese Patent Application Nos. 2015-055959, filed on Mar. 19, 2015, and 2016-021104 filed on Feb. 5, 2016, in the Japanese Patent Office, the entire disclosure of each of which is hereby incorporated by reference herein.

BACKGROUND

Technical Field

Exemplary aspects of the present disclosure relate to a fixing device, an image forming apparatus, and a fixing method, and more particularly, to a fixing device for fixing a toner image on a recording medium, an image forming apparatus incorporating the fixing device, and a fixing method for fixing a toner image on a recording medium.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one exemplary embodiment, the fixing device includes a fixing rotator rotatable in a predetermined direction of rotation and a pressure rotator to press against the fixing rotator to form a fixing nip between the fixing rotator and the pressure rotator, through which a recording medium bearing a toner image is conveyed. A primary heater is disposed opposite a primary heating span of the fixing rotator to heat the primary heating span of the fixing rotator. A secondary heater is disposed opposite a secondary heating span of the fixing rotator to heat the secondary heating span of the fixing rotator. The secondary heating span is outboard from the primary heating span in an axial direction of the fixing rotator. A tertiary heater is disposed opposite a tertiary heating span of the fixing rotator to heat the tertiary heating span of the fixing rotator. The tertiary heating span is outboard from the secondary heating span in the axial direction of the fixing rotator. A primary temperature detector is disposed opposite the primary heating span of the fixing rotator to detect a temperature of the primary heating span of the fixing rotator. A secondary temperature detector is disposed opposite the secondary heating span of the fixing rotator to detect a temperature of the secondary heating span of the fixing rotator. A tertiary temperature detector is disposed opposite the tertiary heating span of the pressure rotator to detect a temperature of the tertiary heating span of the pressure rotator. A controller selectively performs a primary control mode to de-energize the tertiary heater and a secondary control mode to connect the secondary heater and the tertiary heater in series to energize the primary heater, the secondary heater, and the tertiary heater. The controller energizes the secondary heater and the tertiary heater in the secondary control mode based on the temperature of the fixing rotator and the pressure rotator detected by the secondary temperature detector and the tertiary temperature detector, respectively.

This specification further describes an improved image forming apparatus. In one exemplary embodiment, the image forming apparatus includes an image bearer to bear a toner image and a fixing rotator disposed downstream from the image bearer in a recording medium conveyance direction and rotatable in a predetermined direction of rotation. A pressure rotator presses against the fixing rotator to form a fixing nip between the fixing rotator and the pressure rotator, through which a recording medium bearing the toner image is conveyed. A primary heater is disposed opposite a primary heating span of the fixing rotator to heat the primary heating span of the fixing rotator. A secondary heater is disposed opposite a secondary heating span of the fixing rotator to heat the secondary heating span of the fixing rotator. The secondary heating span is outboard from the primary heating span in an axial direction of the fixing rotator. A tertiary heater is disposed opposite a tertiary heating span of the fixing rotator to heat the tertiary heating span of the fixing rotator. The tertiary heating span is outboard from the secondary heating span in the axial direction of the fixing rotator. A power supply supplies power to the primary heater, the secondary heater, and the tertiary heater. A primary temperature detector is disposed opposite the primary heating span of the fixing rotator to detect a temperature of the primary heating span of the fixing rotator. A secondary temperature detector is disposed opposite the secondary heating span of the fixing rotator to detect a temperature of the secondary heating span of the fixing rotator. A tertiary temperature detector is disposed opposite the tertiary heating span of the pressure rotator to detect a temperature of the tertiary heating span of the pressure rotator. A controller selectively performs a primary control mode to de-energize the tertiary heater and a secondary control mode to connect the secondary heater and the tertiary heater in series to energize the primary heater, the secondary heater, and the tertiary heater. The controller energizes the secondary heater and the tertiary heater in the secondary control mode based on the temperature of the fixing rotator and the pressure rotator detected by the secondary temperature detector and the tertiary temperature detector, respectively.

This specification further describes an improved fixing method. In one exemplary embodiment, the fixing method includes determining that a recording medium has a predetermined size or greater; energizing a primary heater, a secondary heater, and a tertiary heater to heat a primary heating span, a secondary heating span, and a tertiary heating span of a fixing rotator, respectively; determining that a temperature of the primary heating span and the secondary heating span of the fixing rotator reaches a target temperature and a temperature of the tertiary heating span of a pressure rotator is a first predetermined temperature or higher; starting conveying the recording medium to the fixing rotator; determining that the temperature of the tertiary heating span of the pressure rotator is lower than a second predetermined temperature; determining that the temperature of the tertiary heating span of the pressure rotator is a third predetermined temperature or lower; and increasing the target temperature.

BRIEF DESCRIPTION OF THE DRAWINGS

A more complete appreciation of the disclosure and the many attendant advantages thereof will be readily obtained as the same becomes better understood by reference to the following detailed description when considered in connection with the accompanying drawings, wherein:

FIG. 15 divided into

DETAILED DESCRIPTION OF THE DISCLOSURE

Figure 1:
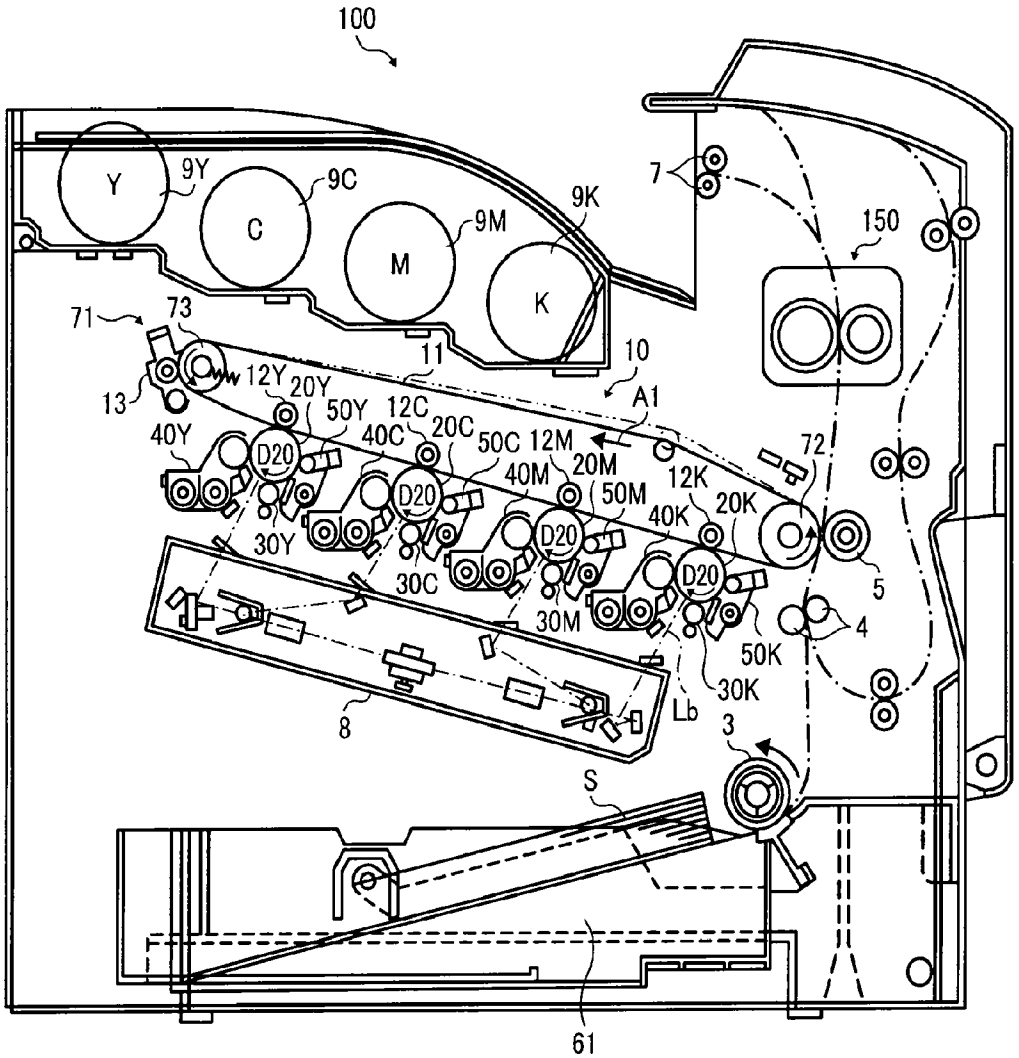
FIG. 1 is a schematic vertical cross-sectional view of an image forming apparatus according to an exemplary embodiment of the present disclosure.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 100 according to an exemplary embodiment of the present disclosure is explained.

It is to be noted that, in the drawings for explaining exemplary embodiments of this disclosure, identical reference numerals are assigned, as long as discrimination is possible, to components such as members and component parts having an identical function or shape, thus omitting description thereof once it is provided.

FIG. 1 is a schematic vertical cross-sectional view of the image forming apparatus 100. The image forming apparatus 100 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 100 is a color printer that forms color and monochrome toner images on a recording medium by electrophotography. Alternatively, the image forming apparatus 100 may be a monochrome printer that forms a monochrome toner image on a recording medium.

A description is provided of a construction and an operation of the image forming apparatus 100.

The image forming apparatus 100 is a color printer employing a tandem system in which a plurality of image forming devices for forming toner images in a plurality of colors, respectively, is aligned in a rotation direction of an intermediate transfer belt.

The image forming apparatus 100 includes four photoconductive drums 20Y, 20C, 20M, and 20K serving as image bearers that bear yellow, cyan, magenta, and black toner images in separation colors, respectively, that is, yellow, cyan, magenta, and black. The yellow, cyan, magenta, and black toner images formed on the photoconductive drums 20Y, 20C, 20M, and 20K as visible images, respectively, are primarily transferred successively onto an intermediate transfer belt 11 serving as an intermediate transferor disposed opposite the photoconductive drums 20Y, 20C, 20M, and 20K as the intermediate transfer belt 11 rotates in a rotation direction A1 such that the yellow, cyan, magenta, and black toner images are superimposed on a same position on the intermediate transfer belt 11 in a primary transfer process. Thereafter, the yellow, cyan, magenta, and black toner images superimposed on the intermediate transfer belt 11 are secondarily transferred onto a sheet S serving as a recording medium collectively in a secondary transfer process. Each of the photoconductive drums 20Y, 20C, 20M, and 20K is surrounded by image forming components that form the yellow, cyan, magenta, and black toner images on the photoconductive drums 20Y, 20C, 20M, and 20K as the photoconductive drums 20Y, 20C, 20M, and 20K rotate clockwise in FIG. 1 in a rotation direction D20.

Taking the photoconductive drum 20K that forms the black toner image, the following describes a construction of components that form the black toner image.

The photoconductive drum 20K is surrounded by a charger 30K, a developing device 40K, a primary transfer roller 12K, and a cleaner 50K in this order in the rotation direction D20 of the photoconductive drum 20K. Similarly, the photoconductive drums 20Y, 20C, and 20M are surrounded by chargers 30Y, 30C, and 30M, developing devices 40Y, 40C, and 40M, primary transfer rollers 12Y, 12C, and 12M, and cleaners 50Y, 50C, and 50M in this order in the rotation direction D20 of the photoconductive drums 20Y, 20C, and 20M, respectively. The charger 30K uniformly changes an outer circumferential surface of the photoconductive drum 20K. An optical writing device 8 optically writes an electrostatic latent image on the charged outer circumferential surface of the photoconductive drum 20K according to image data sent from an external device such as a client computer. The developing device 40K visualizes the electrostatic latent image as a black toner image.

As the intermediate transfer belt 11 rotates in the rotation direction A1, the yellow, cyan, magenta, and black toner images formed on the photoconductive drums 20Y, 20C, 20M, and 20K, respectively, are primarily transferred successively onto the intermediate transfer belt 11, thus being superimposed on the same position on the intermediate transfer belt 11 and formed into a color toner image. In the primary transfer process, the primary transfer rollers 12Y, 12C, 12M, and 12K disposed opposite the photoconductive drums 20Y, 20C, 20M, and 20K via the intermediate transfer belt 11, respectively, apply a primary transfer bias to the photoconductive drums 20Y, 20C, 20M, and 20K successively from the upstream photoconductive drum 20Y to the downstream photoconductive drum 20K in the rotation direction A1 of the intermediate transfer belt 11. The photoconductive drums 20Y, 20C, 20M, and 20K are aligned in this order in the rotation direction A1 of the intermediate transfer belt 11. The photoconductive drums 20Y, 20C, 20M, and 20K are located in four image forming stations that form the yellow, cyan, magenta, and black toner images, respectively.

The image forming apparatus 100 includes the four image forming stations that form the yellow, cyan, magenta, and black toner images, respectively, an intermediate transfer belt unit 10, a secondary transfer roller 5, an intermediate transfer belt cleaner 13, and the optical writing device 8. The intermediate transfer belt unit 10 is situated above and disposed opposite the photoconductive drums 20Y, 20C, 20M, and 20K. The intermediate transfer belt unit 10 incorporates the intermediate transfer belt 11 and the primary transfer rollers 12Y, 12C, 12M, and 12K. The secondary transfer roller 5 serves as a secondary transferor disposed opposite the intermediate transfer belt 11 and driven and rotated in accordance with rotation of the intermediate transfer belt 11. The intermediate transfer belt cleaner 13 is disposed opposite the intermediate transfer belt 11 to clean the intermediate transfer belt 11. The optical writing device 8 is situated below and disposed opposite the four image forming stations.

The optical writing device 8 includes a semiconductor laser serving as a light source, a coupling lens, an fθ lens, a troidal lens, a deflection mirror, and a rotatable polygon mirror serving as a deflector. The optical writing device 8 emits light beams Lb corresponding to the yellow, cyan, magenta, and black toner images to be formed on the photoconductive drums 20Y, 20C, 20M, and 20K thereto, forming electrostatic latent images on the photoconductive drums 20Y, 20C, 20M, and 20K, respectively. FIG. 1 illustrates the light beam Lb irradiating the photoconductive drum 20K. Similarly, light beams irradiate the photoconductive drums 20Y, 20C, and 20M, respectively.

The image forming apparatus 100 further includes a sheet feeder 61 and a registration roller pair 4. The sheet feeder 61, disposed in a lower portion of the image forming apparatus 100, incorporates a paper tray that loads a plurality of sheets S to be conveyed to a secondary transfer nip formed between the intermediate transfer belt 11 and the secondary transfer roller 5. The registration roller pair 4 serving as a conveyor conveys the sheet S conveyed from the sheet feeder 61 to the secondary transfer nip formed between the intermediate transfer belt 11 and the secondary transfer roller 5 at a predetermined time when the yellow, cyan, magenta, and black toner images superimposed on the intermediate transfer belt 11 reach the secondary transfer nip. The image forming apparatus 100 further includes a sensor for detecting that a leading edge of the sheet S reaches the registration roller pair 4.

The secondary transfer roller 5 secondarily transfers the color toner image formed on the intermediate transfer belt 11 onto the sheet S as the sheet S is conveyed through the secondary transfer nip. The sheet S bearing the color toner image is conveyed to a fixing device 150 where the color toner image is fixed on the sheet S under heat and pressure. An output roller pair 7 ejects the sheet S bearing the fixed color toner image onto an output tray disposed atop the image forming apparatus 100. In an upper portion of the image forming apparatus 100 and below the output tray are toner bottles 9Y, 9C, 9M, and 9K containing fresh yellow, cyan, magenta, and black toners, respectively.

The intermediate transfer belt unit 10 includes a driving roller 72 and a driven roller 73 over which the intermediate transfer belt 11 is looped, in addition to the intermediate transfer belt 11 and the primary transfer rollers 12Y, 12C, 12M, and 12K. Since the driven roller 73 also serves as a tension applicator that applies tension to the intermediate transfer belt 11, a biasing member (e.g., a spring) biases the driven roller 73 against the intermediate transfer belt 11. The intermediate transfer belt unit 10, the secondary transfer roller 5, and the intermediate transfer belt cleaner 13 constitute a transfer device 71. The sheet feeder 61 includes a feed roller 3 that contacts an upper side of an uppermost sheet S of the plurality of sheets S loaded on the paper tray of the sheet feeder 61. As the feed roller 3 is driven and rotated counterclockwise in FIG. 1, the feed roller 3 feeds the uppermost sheet S to the registration roller pair 4.

The intermediate transfer belt cleaner 13 of the transfer device 71 includes a cleaning brush and a cleaning blade disposed opposite the intermediate transfer belt 11 to come into contact with the intermediate transfer belt 11. The cleaning brush and the cleaning blade scrape a foreign substance such as residual toner particles off the intermediate transfer belt 11, removing the foreign substance from the intermediate transfer belt 11 and thereby cleaning the intermediate transfer belt 11. The intermediate transfer belt cleaner 13 further includes a waste toner conveyer that conveys the residual toner particles removed from the intermediate transfer belt 11.

Figure 2:
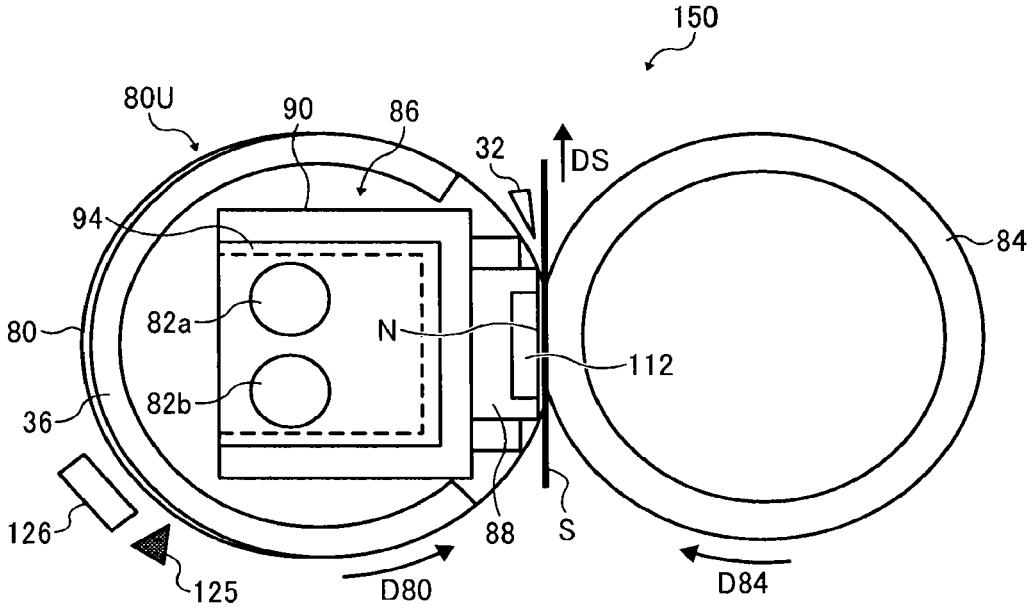
FIG. 2 is a schematic vertical cross-sectional view of a fixing device according to a first exemplary embodiment that is incorporated in the image forming apparatus illustrated in FIG. 1.

Referring to FIG. 2, a description is provided of a configuration of the fixing device 150 incorporated in the image forming apparatus 100 having the construction described above.

FIG. 2 is a schematic vertical cross-sectional view of the fixing device 150. As illustrated in FIG. 2, the fixing device 150 (e.g., a fuser or a fusing unit) includes a thin, flexible, endless fixing belt 80, serving as an endless belt or a fixing rotator, formed into a loop and rotatable in a rotation direction D80 and a pressure roller 84 serving as a pressure rotator disposed opposite the fixing belt 80 and rotatable in a rotation direction D84. Inside the loop formed by the fixing belt 80 is a nip formation assembly 86 (e.g., a nip formation unit) that forms a fixing nip N between the fixing belt 80 and the pressure roller 84, through which a sheet S serving as a recording medium is conveyed.

A detailed description is now given of a construction of the nip formation assembly 86.

The nip formation assembly 86 includes a nip formation pad 88, a lateral end heater 112, and a stay 90. The nip formation pad 88, disposed inside the loop formed by the fixing belt 80 and disposed opposite the pressure roller 84, presses against the pressure roller 84 via the fixing belt 80 to form the fixing nip N between the fixing belt 80 and the pressure roller 84. The lateral end heater 112 is mounted on each lateral end of the nip formation pad 88 in a longitudinal direction thereof parallel to an axial direction of the fixing belt 80. The stay 90 supports the nip formation pad 88 against pressure from the pressure roller 84. An inner circumferential surface of the fixing belt 80 slides over the nip formation pad 88 via a low-friction sheet serving as a slide sheet. The low-friction sheet is applied with a lubricant such as fluorine grease and silicone oil to decrease a slide torque of the fixing belt 80. Alternatively, the nip formation pad 88 may contact the inner circumferential surface of the fixing belt 80 directly without the low-friction sheet sandwiched between the nip formation pad 88 and the fixing belt 80.

The stay 90 has a box shape with an opening opposite the fixing nip N. A halogen heater 82*a* serving as a primary heater and a halogen heater 82*b* serving as a secondary heater are disposed inside the box of the stay 90. The halogen heaters 82*a* and 82*b* emit light that irradiates the inner circumferential surface of the fixing belt 80 directly through the opening of the stay 90, heating the fixing belt 80 with radiation heat. A platy reflector 94 is mounted on an interior surface of the stay 90 to reflect light radiated from the halogen heaters 82*a* and 82*b* toward the fixing belt 80 so as to improve heating efficiency of the halogen heaters 82*a* and 82*b* to heat the fixing belt 80. The reflector 94 prevents light from the halogen heaters 82*a* and 82*b* from heating the stay 90, suppressing waste of energy. Alternatively, instead of the reflector 94, the interior surface of the stay 90 may be treated with insulation or mirror finish to reflect light radiated from the halogen heaters 82*a* and 82*b* toward the fixing belt 80.

A detailed description is now given of a construction of the pressure roller 84.

Figure 3:
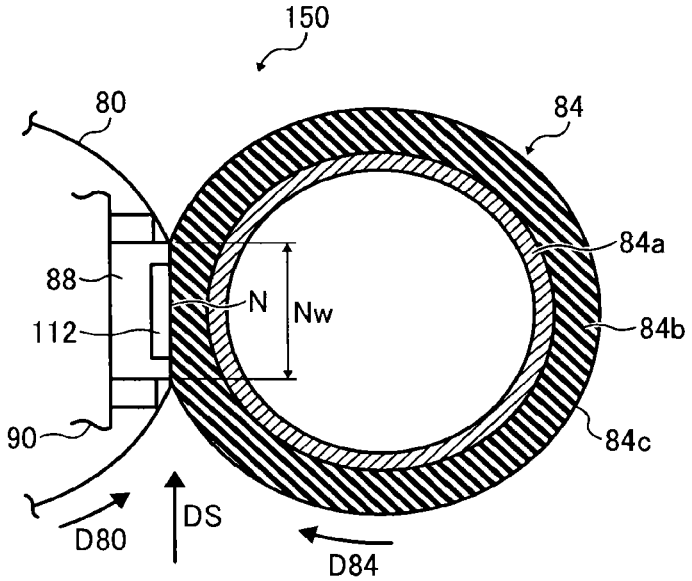
FIG. 3 is a partial vertical cross-sectional view of the fixing device illustrated in FIG. 2.

FIG. 3 is a partial vertical cross-sectional view of the fixing device 150. As illustrated in FIG. 3, the pressure roller 84 is constructed of a hollow metal roller 84*a*, an elastic layer 84*b* coating an outer circumferential surface of the metal roller 84*a* and being made of silicone rubber, and a release layer 84*c* coating an outer circumferential surface of the elastic layer 84*b*. The release layer 84*c*, having a layer thickness in a range of from 5 micrometers to 50 micrometers, is made of perfluoroalkoxy fluoro resin (PFA) or polytetrafluoroethylene (PTFE) to facilitate separation of the sheet S from the pressure roller 84. As a driving force generated by a driver (e.g., a motor) situated inside the image forming apparatus 100 depicted in FIG. 1 is transmitted to the pressure roller 84 through a gear train, the pressure roller 84 rotates in the rotation direction D84. Alternatively, the driver may also be connected to the fixing belt 80 to drive and rotate the fixing belt 80. A spring or the like biases the pressure roller 84 against the fixing belt 80. As the elastic layer 84*b* of the pressure roller 84 is pressed and deformed, the pressure roller 84 produces the fixing nip N having a predetermined length Nw in a sheet conveyance direction DS. Alternatively, the pressure roller 84 may be a solid roller. However, a hollow roller has a decreased thermal capacity. Further, a heater or a heat source such as a halogen heater may be disposed inside the pressure roller 84. The elastic layer 84*b* may be made of solid rubber. Alternatively, if no heater is situated inside the pressure roller 84, the elastic layer 84*b* may be made of sponge rubber. The sponge rubber is more preferable than the solid rubber because the sponge rubber has an increased insulation that draws less heat from the fixing belt 80.

A detailed description is now given of a construction of the fixing belt 80.

The fixing belt 80 is an endless belt or film having a layer thickness in a range of from 30 micrometers to 50 micrometers and made of metal such as nickel and SUS stainless steel or resin such as polyimide. The fixing belt 80 is constructed of a base layer and a release layer. The release layer constituting an outer surface layer is made of PFA, PTFE, or the like to facilitate separation of toner of a toner image on the sheet S from the fixing belt 80, thus preventing the toner of the toner image from adhering to the fixing belt 80. Optionally, an elastic layer may be sandwiched between the base layer and the release layer and made of silicone rubber or the like. If the fixing belt 80 does not incorporate the elastic layer, the fixing belt 80 has a decreased thermal capacity that improves fixing property of being heated quickly to a desired fixing temperature at which the toner image is fixed on the sheet S. However, as the pressure roller 84 and the fixing belt 80 sandwich and press the unfixed toner image on the sheet S passing through the fixing nip N, slight surface asperities of the fixing belt 80 may be transferred onto the toner image on the sheet S, resulting in variation in gloss of the solid toner image on the sheet S.

To address this circumstance, the elastic layer made of silicone rubber has a thickness not smaller than 100 micrometers. As the elastic layer deforms, the elastic layer absorbs slight surface asperities of the fixing belt 80, suppressing variation in gloss of the toner image on the sheet S. As illustrated in FIG. 2, as the pressure roller 84 rotates in the rotation direction D84, the fixing belt 80 rotates in the rotation direction D80 in accordance with rotation of the pressure roller 84 by friction between the pressure roller 84 and the fixing belt 80. At the fixing nip N, the fixing belt 80 rotates as the fixing belt 80 is sandwiched between the pressure roller 84 and the nip formation pad 88; at a circumferential span of the fixing belt 80 other than the fixing nip N, the fixing belt 80 rotates while the fixing belt 80 is supported at each lateral end in the axial direction thereof to retain a tubular shape. Thus, the fixing belt 80 is retained circular in cross-section stably. As illustrated in FIG. 2, a separator 32 is disposed downstream from the fixing nip N in the sheet conveyance direction DS to separate the sheet S from the fixing belt 80.

According to this exemplary embodiment, as illustrated in FIGS. 2 and 3, the fixing nip N is planar. Alternatively, the fixing nip N may define a curve projecting toward the fixing belt 80 to produce a recess in the fixing belt 80 in cross-section or other shapes. If the fixing nip N defines the recess in the fixing belt 80, the recessed fixing nip N directs the leading edge of the sheet S toward the pressure roller 84 as the sheet S is ejected from the fixing nip N, facilitating separation of the sheet S from the fixing belt 80 and suppressing jamming of the sheet S. In this case, a nip formation face of the nip formation pad 88 is contoured into the recess. Similarly, a fixing nip side face of the lateral end heater 112, serving as a tertiary heater coupled with the nip formation pad 88, may be contoured along the recessed nip formation face of the nip formation pad 88.

A detailed description is now given of a configuration of the stay 90.

The stay 90 supports the nip formation pad 88 against pressure from the pressure roller 84 to prevent bending of the nip formation pad 88 and produce the even length Nw of the fixing nip N in the sheet conveyance direction DS throughout the entire width of the fixing belt 80 in the axial direction thereof as illustrated in FIG. 3. As illustrated in FIG. 2, according to this exemplary embodiment, the pressure roller 84 is pressed against the fixing belt 80 to form the fixing nip N. Alternatively, the nip formation assembly 86 may be pressed against the pressure roller 84 to form the fixing nip N. The stay 90 has a mechanical strength great enough to support the nip formation pad 88 to prevent bending of the nip formation pad 88. The stay 90 is made of metal such as stainless steel and iron, metallic oxide such as ceramics, or the like. The fixing belt 80 and the components disposed inside the loop formed by the fixing belt 80, that is, the halogen heaters 82*a* and 82*b*, the nip formation pad 88, the lateral end heater 112, the stay 90, and the reflector 94, may constitute a belt unit 80U separably coupled with the pressure roller 84.

Figure 4:
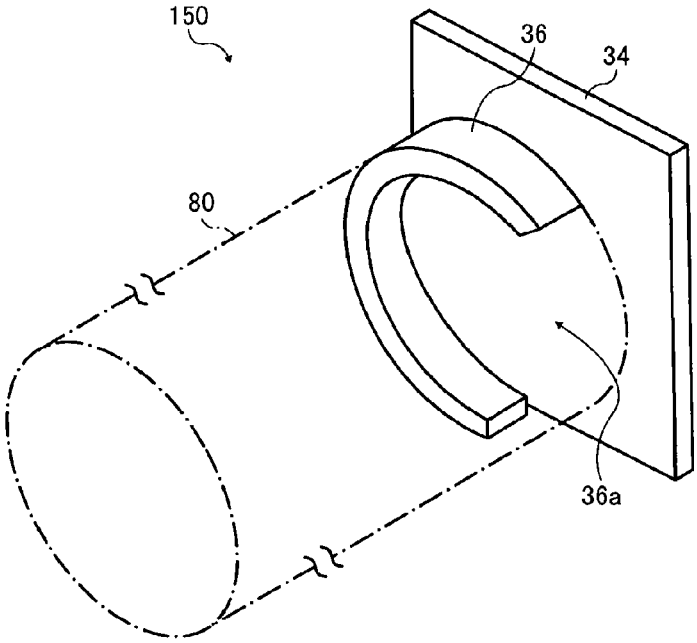
FIG. 4 is a partial perspective view of the fixing device illustrated in FIG. 2.

FIG. 4 is a partial perspective view of the fixing device 150. As illustrated in FIG. 4, both lateral ends of the fixing belt 80 in the axial direction thereof are rotatably supported by flanges 36, respectively. Each of the flanges 36 serves as a support projecting from a side plate 34 in the axial direction of the fixing belt 80. Although FIG. 4 illustrates the flange 36 and the side plate 34 situated at one lateral end of the fixing belt 80 in the axial direction thereof, the flange 36 and the side plate 34 are also situated at another lateral end of the fixing belt 80 in the axial direction thereof. The flange 36 that guides each lateral end of the fixing belt 80 in the axial direction thereof has an outer diameter substantially equivalent to an inner diameter of the fixing belt 80. The flange 36 projects inboard from a lateral edge of the fixing belt 80 by a length in a range of from 5 mm to 10 mm in the axial direction of the fixing belt 80. The flanges 36 guide the fixing belt 80 even when the fixing belt 80 rotates, retaining the fixing belt 80 to be circular in cross-section. The flange 36 includes a slit 36*a* disposed opposite the fixing nip N to place the nip formation assembly 86 at a predetermined position. The stay 90 depicted in FIG. 2 has a width that spans the entire width of the fixing belt 80 in the axial direction thereof. Both lateral ends of the stay 90 in the axial direction of the fixing belt 80 are fixedly mounted on the side plates 34, respectively, thus being supported and positioned by the side plates 34.

A detailed description is now given of a configuration of the halogen heaters 82*a* and 82*b* and the lateral end heater 112.

Figure 5:
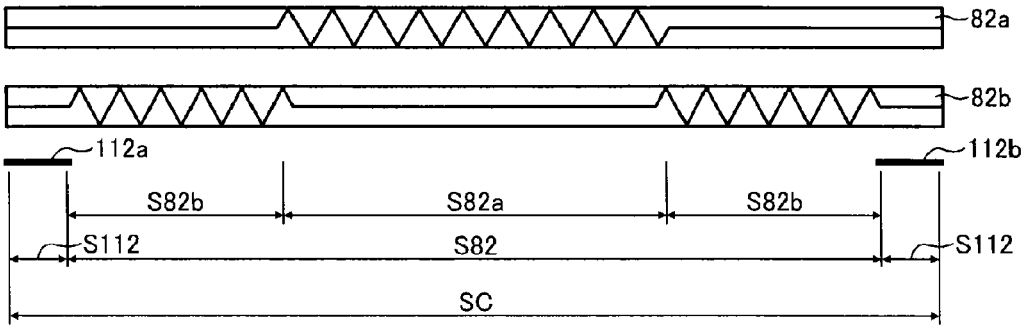
FIG. 5 is a plan view of halogen heaters and lateral end heaters incorporated in the fixing device illustrated in FIG. 2.

FIG. 5 is a plan view of the halogen heaters 80*a* and 82*b* and the lateral end heater 112 constructed of lateral end heaters 112*a* and 112*b*, illustrating a light distribution of the halogen heaters 82*a* and 82*b* and a positional relation between the halogen heaters 82*a* and 82*b* and the lateral end heaters 112*a* and 112*b*. FIG. 5 illustrates a heating span S82 in the axial direction of the fixing belt 80 where the halogen heaters 82*a* and 82*b* heat the fixing belt 80. The heating span S82 is equivalent to a width of an A3 size sheet in portrait orientation in the axial direction of the fixing belt 80. FIG. 5 further illustrates a combined heating span SC in the axial direction of the fixing belt 80 where the halogen heaters 82*a* and 82*b* and the lateral end heaters 112*a* and 112*b* heat the fixing belt 80. The combined heating span SC is equivalent to a width of an A3 extension size sheet and a 13-inch sheet in portrait orientation in the axial direction of the fixing belt 80. As illustrated in FIG. 5, the halogen heater 82*a*serves as a primary heater having a dense light distribution in a primary heating span S82*a* disposed opposite a center span of the fixing belt 80 in the axial direction thereof where a small sheet S having a decreased width in the axial direction of the fixing belt 80 is conveyed over the fixing belt 80. Conversely, the halogen heater 82*b*serves as a secondary heater having a dense light distribution in a secondary heating span S82*b* disposed opposite each lateral end span of the fixing belt 80 in the axial direction thereof where a medium sheet S having a medium width (e.g., an A3 size sheet) in the axial direction of the fixing belt 80 is conveyed over the fixing belt 80. As the small sheet S is conveyed over the fixing belt 80, the halogen heater 82*a* is powered on and the halogen heater 82*b* is not powered on, thus preventing each lateral end span, that is, a non-conveyance span, of the fixing belt 80 in the axial direction thereof where the small sheet S is not conveyed from being heated unnecessarily.

The width of the A3 size sheet in portrait orientation and a width of an A4 size sheet in landscape orientation are smaller than the width of the A3 extension size sheet in portrait orientation (e.g., 329 mm) and the width of the 13-inch sheet in portrait orientation (e.g., 330 mm) by a differential in a range of from 32 mm to 33 mm, respectively. Accordingly, if the fixing device 150 is configured to heat each lateral end span of the fixing belt 80 in the axial direction thereof, that is, if the fixing device 150 is configured to heat a half of the differential in range of from 32 mm to 33 mm, that is, a span in a range of from 16.0 mm to 16.5 mm, the maximum width of sheets S available in the fixing device 150 increases from the width of the A3 size sheet equivalent to the heating span S82 to the width of the A3 extension size sheet or the like equivalent to the combined heating span SC as illustrated in FIG. 5. In other words, if the fixing device 150 is configured to heat an outboard span of the fixing belt 80 disposed opposite an outboard span of the halogen heater 82*b* that is outboard from the secondary heating span S82*b* in the axial direction of the fixing belt 80 and does not have the dense light distribution, the large sheet S (e.g., the A3 extension size sheet) is available in the fixing device 150. Accordingly, the fixing device 150 includes the lateral end heater 112 constructed of downsized heaters, that is, the lateral end heaters 112*a* and 112*b* serving as a tertiary heater or a lateral end heater, each of which has a decreased width of about 20 mm in the axial direction of the fixing belt 80.

As the large sheet S (e.g., the A3 extension size sheet and the 13-inch sheet) is conveyed through the fixing nip N, the halogen heaters 82*a* and 82*b* and the lateral end heaters 112*a* and 112*b* are energized. Conversely, as the small sheet S (e.g., a sheet not greater than the A3 size sheet) is conveyed through the fixing nip N, the halogen heaters 82*a* and 82*b* are energized or the halogen heater 82*a* is energized. Hence, the lateral end heaters 112*a* and 112*b* are not energized. If the halogen heater 82*b* is configured to have an increased heating span, that is, the combined heating span SC, to heat the large sheet S such as the A3 extension size sheet, the halogen heater 82*b* may heat the outboard span of the fixing belt 80 unnecessarily while the large sheet S is not conveyed through the fixing nip N, wasting energy. To address this circumstance, the fixing device 150 according to this exemplary embodiment incorporates a simple mechanism in addition to the halogen heaters 82*a* and 82*b*, that is, the lateral end heaters 112*a* and 112*b* being disposed opposite both lateral end heating spans, that is, both tertiary heating spans S112, in the axial direction of the fixing belt 80 or in proximity to both lateral ends of the fixing belt 80 in the axial direction thereof, respectively.

The A3 size sheet in portrait orientation and the A4 size sheet in landscape orientation are used frequently in the fixing device 150 for printing. However, fixing devices may use sheets of other sizes frequently because the sizes of the sheets frequently used vary depending on the destination for commercial shipment and usage of the fixing devices. For example, in a fixing device that uses a double letter (DLT) size sheet in portrait orientation and a letter (LT) size sheet in landscape orientation frequently, the halogen heaters 82*a* and 82*b* are disposed outboard from the DLT size sheet and the LT size sheet in the axial direction of the fixing belt 80. Accordingly, the lateral end heaters 112*a* and 112*b* are disposed opposite a sheet greater than the DLT size sheet and the LT size sheet.

Each of the lateral end heaters 112*a* and 112*b* may have a positive temperature coefficient (PTC) property. Accordingly, a resistance value increases at a preset temperature or higher and the lateral end heaters 112*a* and 112*b* do not generate heat at the preset temperature or higher. Hence, the lateral end heaters 112*a* and 112*b* do not burn or damage the fixing belt 80, achieving the safe fixing device 150. Additionally, each of the lateral end heaters 112*a* and 112*b* situated inside the loop formed by the fixing belt 80 emits light that irradiates the inner circumferential surface of the fixing belt 80 to heat the tertiary heating span S112 of the fixing belt 80 without degrading rotation of the fixing belt 80.

A description is provided of securing of the lateral end heaters 112*a* and 112*b* to the nip formation pad 88 and securing of the nip formation pad 88 to the stay 90.

Figure 6:
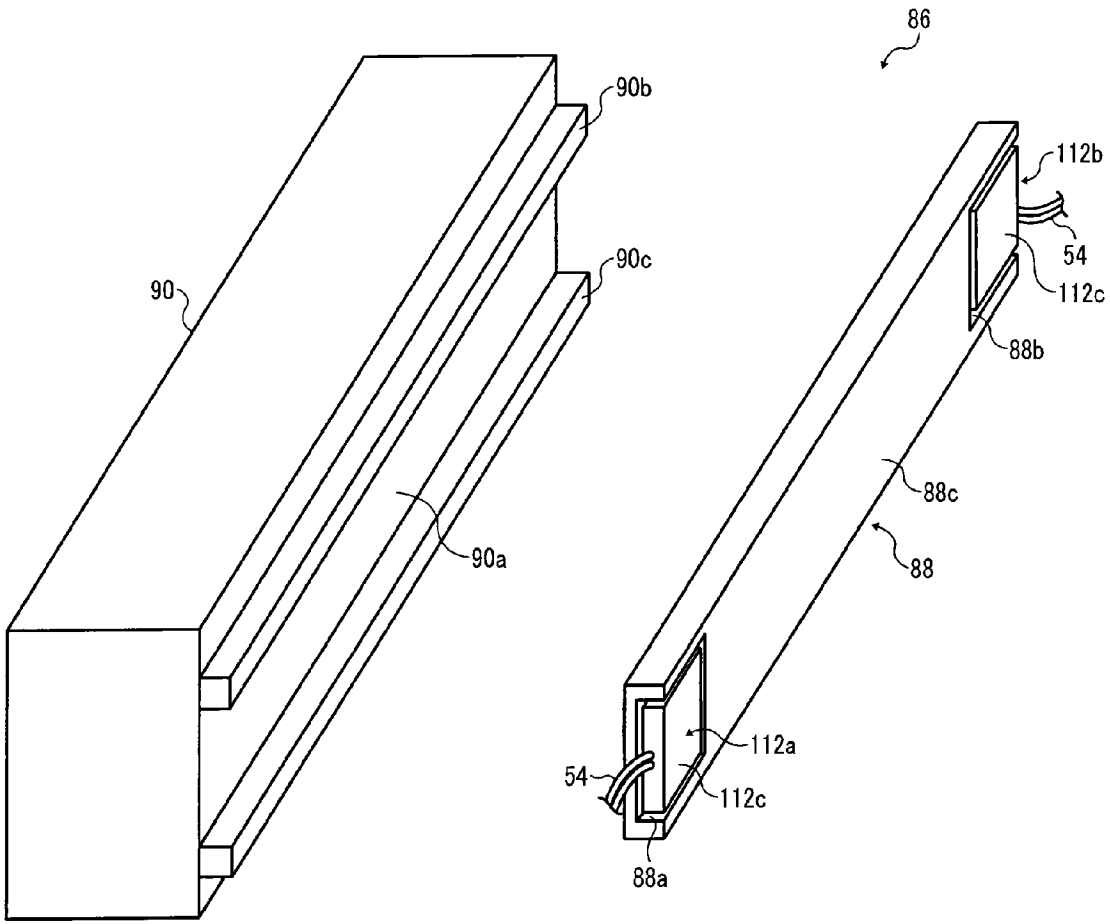
FIG. 6 is an exploded perspective view of a nip formation assembly incorporated in the fixing device illustrated in FIG. 2.

FIG. 6 is an exploded perspective view of the nip formation assembly 86. If a fixing belt side face 112*c* of the respective lateral end heaters 112*a* and 112*b* that contacts the inner circumferential surface of the fixing belt 80 is made of a smooth material different from a material of a body of the respective lateral end heaters 112*a* and 112*b*, the smooth material reduces the sliding friction of the fixing belt 80 as the fixing belt 80 slides over the lateral end heaters 112*a* and 112*b*, retaining stable rotation of the fixing belt 80.

As illustrated in FIG. 6, a side face 90*a* of the stay 90 that faces the pressure roller 84 mounts two ridges 90*b* and 90*c* extending in the axial direction of the fixing belt 80. The rectangular nip formation pad 88 is sandwiched and positioned between the two ridges 90*b* and 90*c* in the sheet conveyance direction DS and is secured to the side face 90*a* with an adhesive or the like. Thus, the side face 90*a* and the two ridges 90*b* and 90*c* accommodate the nip formation pad 88. Two recesses 88*a* and 88*b* that define a difference in thickness of the nip formation pad 88 are disposed at both lateral ends of the nip formation pad 88 in the longitudinal direction thereof. The lateral end heaters 112*a* and 112*b* are attached to the recesses 88*a* and 88*b* with an adhesive or the like or secured to the recesses 88*a* and 88*b*, respectively, thus being accommodated by the recesses 88*a* and 88*b*. The nip formation pad 88 includes a nip formation face 88*c* that faces the pressure roller 84.

A description is provided of a configuration of a first comparative fixing device incorporating a fixing roller.

The first comparative fixing device is requested to fix a toner image on sheets of various sizes. To address this request, if the first comparative fixing device employs an elongated heater to correspond to a width of a large sheet, the elongated heater may unnecessarily heat each lateral end span in an axial direction of the fixing roller, that is, a non-conveyance span, of the fixing roller where a small sheet is not conveyed, overheating the non-conveyance span of the fixing roller. To address this circumstance, the first comparative fixing device may convey the sheet at a decreased speed, degrading productivity. Alternatively, the first comparative fixing device may include a first halogen heater and a second halogen heater situated inside the fixing roller. The first halogen heater has a dense light distribution in a center span of the first halogen heater in the axial direction of the fixing roller. Conversely, the second halogen heater has a dense light distribution in each lateral end span of the second halogen heater in the axial direction of the fixing roller. When the small sheet is conveyed through the first comparative fixing device, the first halogen heater is energized to heat a center span of the fixing roller in the axial direction thereof where the small sheet is conveyed.

On the other hand, the first comparative fixing device is requested to fix a toner image on large sheets greater than the A3 size sheet such as the A3 extension size sheet and the 13-inch sheet although the large sheets are used infrequently. To address this circumstance, the first comparative fixing device may incorporate a separate halogen heater having a light distribution corresponding to those large sheets. However, it may be difficult to place the separate halogen heater inside the downsized fixing roller having a restricted diameter.

A description is provided of a configuration of a second comparative fixing device configured to address the above-described circumstances of the first comparative fixing device.

The second comparative fixing device includes a thin, flexible endless belt to be heated quickly to a fixing temperature at which a toner image is fixed on a sheet and a nip formation unit situated inside a loop formed by the endless belt. The nip formation unit presses against a pressure roller via the endless belt to form a fixing nip between the endless belt and the pressure roller. A plurality of halogen heaters having different light distributions, respectively, is situated inside the loop formed by the endless belt. A plurality of lateral end heaters is disposed opposite both lateral end spans of the endless belt in an axial direction thereof, respectively, and upstream from the fixing nip in a rotation direction of the endless belt so as to heat an increased heating span of the endless belt corresponding to the width of the large sheet in the axial direction of the endless belt. The lateral end heaters contact an inner circumferential surface or an outer circumferential surface of the endless belt. The lateral end heaters heat the increased heating span of the endless belt corresponding to the width of the large sheet in the axial direction of the endless belt with a simple construction not incorporating an extra halogen heater directed to the large sheet.

The lateral end heaters are disposed opposite both lateral end spans of the endless belt in the axial direction thereof, respectively. Accordingly, the lateral end heaters are requested to be powered on and off concurrently, complicating a control circuit that controls the lateral end heaters. To address this circumstance, the lateral end heaters may be electrically connected in series and controlled more simply compared to a configuration in which the lateral end heaters are powered on and off separately, while simplifying a temperature sensor that detects the temperature of the endless belt and a safety device that detects failure of the temperature sensor. However, the second comparative fixing device may not control the temperature of the endless belt precisely, causing temperature decrease or overheating of the endless belt that may result in formation of a faulty toner image and failure caused by overheating of the endless belt.

A detailed description is now given of a configuration of the plurality of halogen heaters incorporated in the second comparative fixing device.

The plurality of halogen heaters includes a center halogen heater having a dense light distribution in a center span of the center halogen heater in the axial direction of the endless belt and a lateral end halogen heater having a dense light distribution in each lateral end span of the lateral end halogen heater in the axial direction of the endless belt. As a small sheet is conveyed through the second comparative fixing device, the center halogen heater is powered on. As a medium sheet is conveyed through the second comparative fixing device, the lateral end halogen heater is powered on together with the center halogen heater. The center halogen heater and the lateral end halogen heater are powered on and off properly to heat sheets of various sizes.

Taking the sizes of the sheets and the frequency with which the sheets are conveyed, sheets up to the A3 size sheet are used frequently. The A3 size sheet is conveyed through the second comparative fixing device in portrait orientation. The A4 size sheet and the LT size sheet that are used with an increased frequency are generally conveyed in landscape orientation to enhance productivity. To address this circumstance, the center halogen heater and the lateral end halogen heater produce a heating span of about 300 mm in the axial direction of the endless belt that is great enough to heat 99 percent or more of the sizes of sheets. On the other hand, the second comparative fixing device is requested to fix a toner image on large sheets greater than the A3 size sheet in the axial direction of the endless belt such as the A3 extension size sheet and the 13-inch sheet although the large sheets are used infrequently.

If the plurality of halogen heaters is used as the center halogen heater and the lateral end halogen heater, respectively, the plurality of halogen heaters used to heat the small sheet is situated inside the loop formed by the endless belt or a fixing roller having a diameter of about 30 mm. Accordingly, the number of the halogen heaters is limited. To address this circumstance, the lateral end halogen heater having the dense light distribution in the lateral end span of the lateral end halogen heater may be elongated to span a width of the large sheet greater than the width of the A3 size sheet in the axial direction of the endless belt. As described above, the center halogen heater and the lateral end halogen heater heat the heating span of about 300 mm of the endless belt in the axial direction thereof frequently. However, if the elongated lateral end halogen heater is employed, the elongated lateral end halogen heater may heat an elongated heating span of about 330 mm of the endless belt in the axial direction thereof, wasting energy used to heat a differential between the heating span of about 300 mm and the elongated heating span of about 330 mm. When the A3 size sheet in portrait orientation or the A4 size sheet in landscape orientation is conveyed through the second comparative fixing device, each lateral end of the elongated heating span of the endless belt in the axial direction thereof that corresponds to the differential between the heating span of about 300 mm and the elongated heating span of about 330 mm may overheat. In order to cool the overheated lateral end of the endless belt, productivity defined by a conveyance speed of the sheets may be degraded or a fan may be installed. If a reflection plate is interposed between the lateral end halogen heater and the endless belt, each lateral end of the lateral end halogen heater in the axial direction of the endless belt may overheat. To address those circumstances, the second comparative fixing device has the configuration described above.

A description is provided of a relation between the lateral end heaters 112*a* and 112*b* and the nip formation pad 88.

Figure 7A:
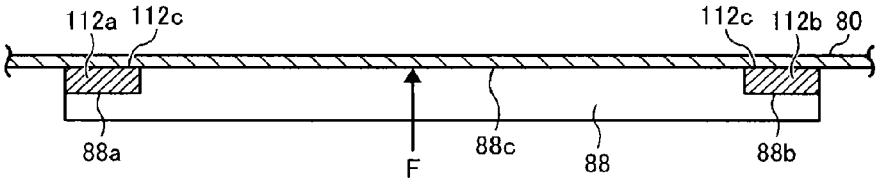
FIG. 7A is a cross-sectional view of a nip formation pad and the lateral end heaters incorporated in the nip formation assembly depicted in FIG. 6, illustrating recesses of the nip formation pad.

FIG. 7A is a cross-sectional view of the fixing belt 80, the nip formation pad 88, and the lateral end heaters 112*a* and 112*b*. As illustrated in FIG. 7A, each of the lateral end heaters 112*a* and 112*b* includes the fixing belt side face 112*c* contacting the inner circumferential surface of the fixing belt 80. The fixing belt side face 112*c* of the respective lateral end heaters 112*a* and 112*b* is leveled with the nip formation face 88*c* of the nip formation pad 88 in a pressurization direction F (e.g., a direction of a reaction force against pressure from the pressure roller 84) in which the nip formation pad 88 presses against the inner circumferential surface of the fixing belt 80. In other words, the fixing belt side face 112*c* contacting the inner circumferential surface of the fixing belt 80 defines an extension of the nip formation face 88*c* in the longitudinal direction of the nip formation pad 88. According to this exemplary embodiment, the lateral end heaters 112*a* and 112*b* are coupled with the nip formation pad 88 to form the fixing nip N. Hence, the lateral end heaters 112*a* and 112*b* are situated in a limited space inside the loop formed by the fixing belt 80, saving space.

The fixing belt side face 112*c* of the respective lateral end heaters 112*a* and 112*b* that contacts the inner circumferential surface of the fixing belt 80 is leveled with the nip formation face 88*c* of the nip formation pad 88 in the pressurization direction F to define an identical plane. Accordingly, the pressure roller 84 is pressed against the lateral end heaters 112*a* and 112*b* via the fixing belt 80 with sufficient pressure. Consequently, the fixing belt 80 rotates in a state in which the fixing belt 80 adheres to the lateral end heaters 112*a* and 112*b*, improving conduction of heat from the lateral end heaters 112*a* and 112*b* to the fixing belt 80 and thereby retaining improved heating efficiency of the lateral end heaters 112*a* and 112*b*. Since the lateral end heaters 112*a* and 112*b* are situated within the fixing nip N in the axial direction of the fixing belt 80 to heat the fixing belt 80, the lateral end heaters 112*a* and 112*b* do not heat a portion of the fixing belt 80 that is outboard from the fixing nip N in the axial direction of the fixing belt 80, preventing residual toner failed to be fixed on the sheet S and therefore remaining on the fixing belt 80 from being melted again and adhered to the fixing belt 80. The pressure roller 84 also serves as a biasing member that presses the fixing belt 80 against the lateral end heaters 112*a* and 112*b* to adhere the fixing belt 80 to the lateral end heaters 112*a* and 112*b* so as to enhance conduction of heat from the lateral end heaters 112*a* and 112*b* to the fixing belt 80. Accordingly, a mechanism that presses the lateral end heaters 112*a* and 112*b* against the fixing belt 80 is not needed, simplifying the fixing device 150. In other words, pressure used to form the fixing nip N is also used to adhere the fixing belt 80 to the lateral end heaters 112*a* and 112*b*, improving conduction of heat from the lateral end heaters 112*a* and 112*b* to the fixing belt 80 without degrading rotation of the fixing belt 80.

Figure 7B:
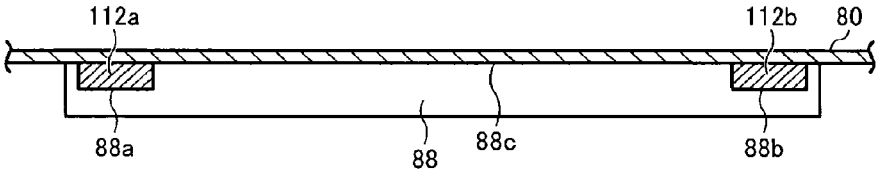
FIG. 7B is a cross-sectional view of the nip formation pad and the lateral end heaters depicted in FIG. 7A, illustrating closed recesses as a first variation of the recesses illustrated in FIG. 7A.

As illustrated in FIG. 6, each of the recesses 88*a* and 88*b* is open at each lateral edge of the nip formation pad 88 in the longitudinal direction thereof Alternatively, each of the recesses 88*a* and 88*b* may be closed and formed in a box defined by a bottom and four walls as illustrated in FIG. 7B. FIG. 7B is a cross-sectional view of the fixing belt 80, the nip formation pad 88, and the lateral end heaters 112*a* and 112*b* illustrating the closed recesses 88*a* and 88*b* as a first variation of the recesses 88*a* and 88*b* illustrated in FIG. 7A. Alternatively, each of the recesses 88*a* and 88*b* may be closed at both ends in the axial direction of the fixing belt 80 and open at both ends in a direction perpendicular to the axial direction of the fixing belt 80.

Figure 8A:
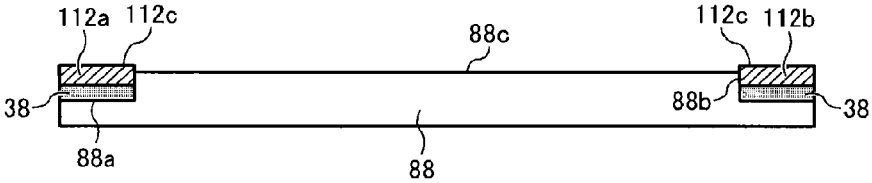
FIG. 8A is a cross-sectional view of the nip formation pad and the lateral end heaters depicted in FIG. 7A, illustrating recesses as a second variation of the recesses illustrated in FIG. 7A.

FIG. 8A is a cross-sectional view of the nip formation pad 88 and the lateral end heaters 112*a* and 112*b* illustrating the recesses 88*a* and 88*b* as a second variation of the recesses 88*a* and 88*b* illustrated in FIG. 7A. As illustrated in FIG. 8A, the recess 88*a* accommodates the lateral end heater 112*a* and an elastic member 38 supporting the lateral end heater 112*a*; the recess 88*b* accommodates the lateral end heater 112*b* and the elastic member 38 supporting the lateral end heater 112*b*. As illustrated in FIG. 8A, when the pressure roller 84 does not press the fixing belt 80 against the lateral end heaters 112*a* and 112*b*, the fixing belt side face 112*c* of the respective lateral end heaters 112*a* and 112*b* that contacts the inner circumferential surface of the fixing belt 80 is not leveled with the nip formation face 88*c* of the nip formation pad 88 in the pressurization direction F.

Figure 8B:
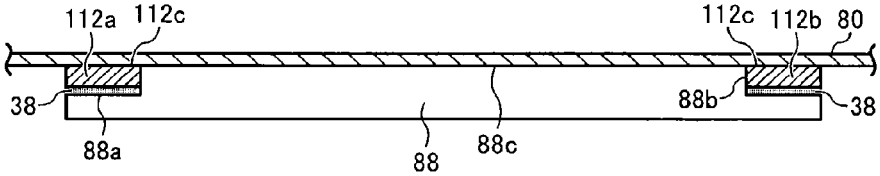
FIG. 8B is a cross-sectional view of the nip formation pad and the lateral end heaters illustrated in FIG. 8A when the lateral end heaters are pressed against a fixing belt.

FIG. 8B is a cross-sectional view of the fixing belt 80, the nip formation pad 88, and the lateral end heaters 112*a* and 112*b* when the pressure roller 84 presses the fixing belt 80 against the lateral end heaters 112*a* and 112*b*. As illustrated in FIG. 8B, when the pressure roller 84 presses the fixing belt 80 against the lateral end heaters 112*a* and 112*b* to form the fixing nip N, the elastic members 38 are deformed by pressure from the pressure roller 84 and the fixing belt side face 112*c* of the respective lateral end heaters 112*a* and 112*b* that contacts the inner circumferential surface of the fixing belt 80 is leveled with the nip formation face 88*c* of the nip formation pad 88 in the pressurization direction F. The elastic member 38 is made of rubber or includes a spring.

Since the lateral end heaters 112*a* and 112*b* are mounted on and fixedly secured to the nip formation pad 88 as a separate component, the fixing belt side face 112*c* of the respective lateral end heaters 112*a* and 112*b* that contacts the inner circumferential surface of the fixing belt 80 may deviate from the nip formation face 88*c* of the nip formation pad 88 in height during assembly of the fixing device 150. To address this circumstance, the elastic members 38 support the lateral end heaters 112*a* and 112*b* to absorb a manufacturing error, thus leveling the fixing belt side face 112*c* of the respective lateral end heaters 112*a* and 112*b* with the nip formation face 88*c* of the nip formation pad 88 when the fixing nip N is formed.

Figure 9:
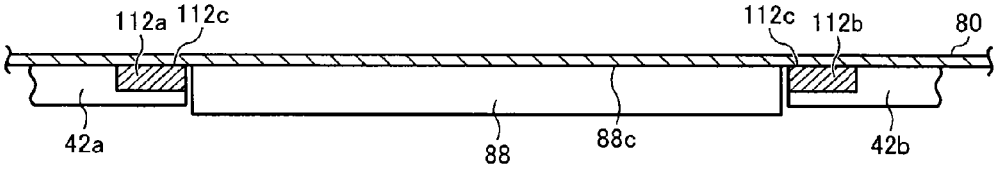
FIG. 9 is a cross-sectional view of the nip formation pad and the lateral end heaters disposed outboard from the nip formation pad as a variation of the nip formation pad and the lateral end heaters illustrated in FIG. 7A.

According to this exemplary embodiment, the lateral end heaters 112*a* and 112*b* are coupled with the nip formation pad 88 to constitute the nip formation assembly 86. However, the lateral end heaters 112*a* and 112*b* may not be coupled with the nip formation pad 88 as illustrated in FIG. 9. FIG. 9 is a cross-sectional view of the fixing belt 80, the nip formation pad 88, and the lateral end heaters 112*a* and 112*b*. As illustrated in FIG. 9, the lateral end heaters 112*a* and 112*b* are disposed outboard from the nip formation pad 88 in the longitudinal direction thereof and within the fixing nip N in the axial direction of the fixing belt 80. Thus, the lateral end heaters 112*a* and 112*b* are separated from the nip formation pad 88 or the nip formation assembly 86. For example, the lateral end heaters 112*a* and 112*b* are mounted on supports 42*a* and 42*b* mounted on the side plates 34 depicted in FIG. 4, respectively. As illustrated in FIG. 9, the fixing belt side face 112*c* of the respective lateral end heaters 112*a* and 112*b* that contacts the inner circumferential surface of the fixing belt 80 is leveled with the nip formation face 88*c* of the nip formation pad 88 in the pressurization direction F. Alternatively, the elastic members 38 depicted in FIGS. 8A and 8B may support the lateral end heaters 112*a* and 112*b* illustrated in FIG. 9, respectively, to displace the lateral end heaters 112*a* and 112*b*.

According to the exemplary embodiments described above, as illustrated in FIG. 2, the nip formation pad 88, the lateral end heaters 112*a* and 112*b* illustrated as the lateral end heater 112 in FIG. 2, the stay 90, and the halogen heaters 82*a* and 82*b* constitute the nip formation assembly 86. Alternatively, the nip formation pad 88 and the lateral end heaters 112*a* and 112*b* may constitute the nip formation assembly 86.

The lateral end heaters 112*a* and 112*b* having the PTC property may take an extended period of time to achieve a predetermined target temperature compared to the halogen heaters 82*a* and 82*b*. For example, if the lateral end heaters 112*a* and 112*b* and the halogen heaters 82*a* and 82*b* are energized simultaneously, the heating span S82 depicted in FIG. 5 of the fixing belt 80 is heated quickly, wasting energy. Further, as the sheets S conveyed over the fixing belt 80 draw heat from the fixing belt 80, the lateral end heaters 112*a* and 112*b*, due to their PTC property, take the extended period of time to retrieve the predetermined target temperature compared to the halogen heaters 82*a* and 82*b*.

To address this circumstance, the fixing device 150 decreases productivity to correspond to a heating cycle of the lateral end heaters 112*a* and 112*b*, thus controlling heating of the fixing belt 80 to reduce variation in temperature of the fixing belt 80 in the axial direction thereof, that is, between the center span and each lateral end span of the fixing belt 80 in the axial direction thereof. For example, while the lateral end heaters 112*a* and 112*b*, which heat both tertiary heating spans S112 of the fixing belt 80 in the axial direction thereof or the vicinity of both lateral ends of the fixing belt 80, respectively, where the A3 extension size sheet is conveyed, are energized, actuation of the halogen heaters 82*a* and 82*b*, which heat an inboard span that is inboard from both tertiary heating spans S112 of the fixing belt 80 in the axial direction thereof and defines the heating span S82 where regular size sheets smaller than the A3 extension size sheet are conveyed, is controlled in accordance with temperature increase of both tertiary heating spans S112 of the fixing belt 80 in the axial direction thereof. Accordingly, the fixing device 150 prevents waste of energy caused by the halogen heaters 82*a* and 82*b* that heat the heating span S82 of the fixing belt 80, where the regular size sheets smaller than the large sheet S are conveyed, quickly and unnecessarily while the lateral end heaters 112*a* and 112*b* generate a decreased amount of heat. A conveyance speed at which the A3 extension size sheet heated by the lateral end heaters 112*a* and 112*b* is conveyed is smaller than a conveyance speed at which the sheets other than the A3 extension size sheet are conveyed. Thus, the fixing device 150 decreases productivity when the infrequently used, large sheet S (e.g., the A3 extension size sheet) is conveyed, simplifying the lateral end heaters 112*a*and 112*b* that heat both tertiary heating spans S112 of the fixing belt 80, respectively, and reducing manufacturing costs. Consequently, the fixing belt 80 is heated effectively.

According to the exemplary embodiments described above, the fixing device 150 includes the two halogen heaters 82*a* and 82*b* serving as a heater that heats the fixing belt 80. Alternatively, the fixing device 150 may include three or more halogen heaters to correspond to various sizes of small sheets S and regular size sheets S.

A description is provided of an electric connection between the halogen heaters 82*a* and 82*b* and the lateral end heaters 112*a* and 112*b*.

Figure 10:
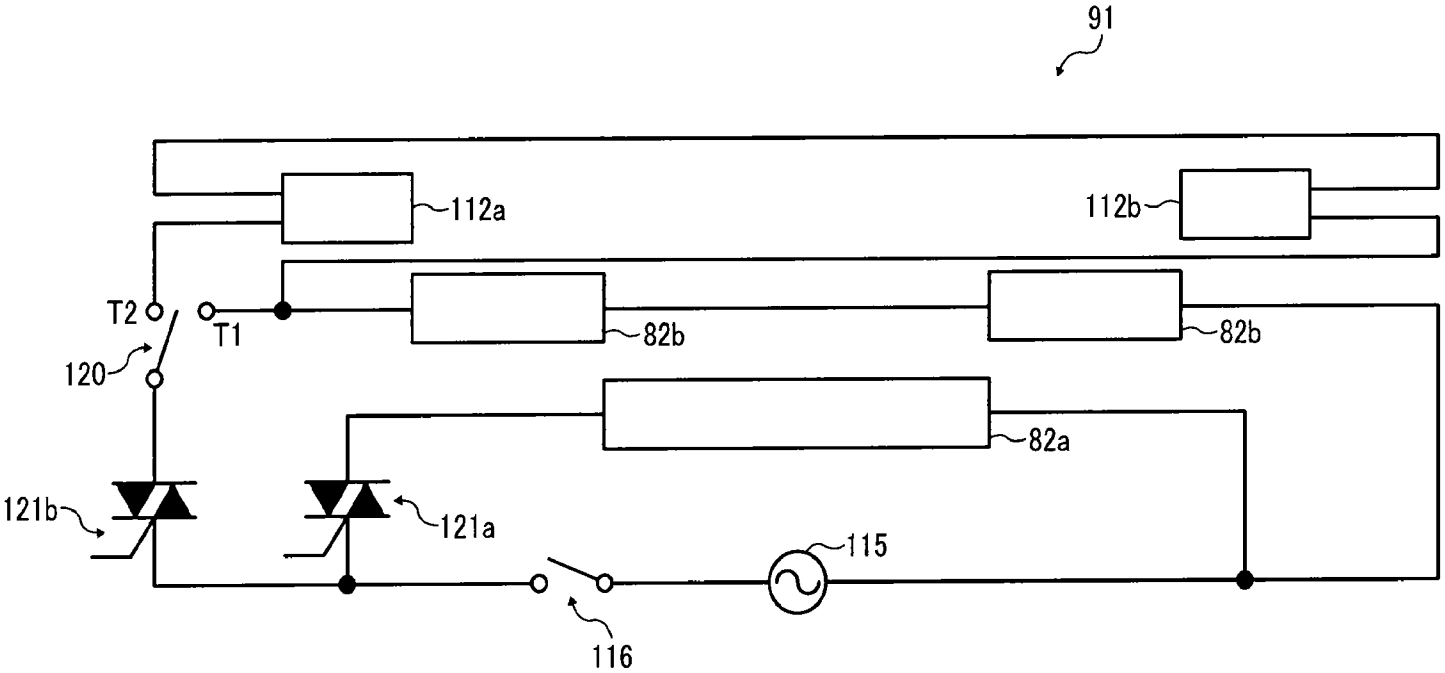
FIG. 10 is a diagram of a control circuit illustrating an electric connection between the halogen heaters and the lateral end heaters illustrated in FIG. 5.

FIG. 10 is a diagram of a control circuit 91 illustrating the electric connection between the halogen heaters 82*a* and 82*b* and the lateral end heaters 112*a* and 112*b* according to an exemplary embodiment. As illustrated in FIG. 10, the control circuit 91 includes a power supply 115, a main switch 116, triacs 121*a* and 121*b*, and a switch 120. The power supply 115 is connected to the halogen heaters 82*a* and 82*b* and the lateral end heaters 112*a* and 112*b*. The main switch 116 is interposed between the power supply 115 and each of the halogen heaters 82*a* and 82*b* and the lateral end heaters 112*a* and 112*b*. The triac 121*a* serving as a primary triac is connected to and interposed between the main switch 116 and the halogen heater 82*a*. The triac 121*b* serves as a secondary triac connected to the switch 120. The triac 121*b*and the switch 120 are interposed between the main switch 116 and each of the halogen heater 82*b* and the lateral end heaters 112*a* and 112*b*.

The switch 120 contacts a primary terminal T1 connected to the halogen heater 82*b* in a primary control mode in which the halogen heaters 82*a* and 82*b* are energized and the lateral end heaters 112*a* and 112*b* are not energized. The switch 120 contacts a secondary terminal T2 connected to the lateral end heaters 112*a* and 112*b* and the halogen heater 82*b* in a secondary control mode in which the halogen heaters 82*a* and 82*b* and the lateral end heaters 112*a* and 112*b* are energized. A controller 130 described below controls an amount of power supplied to each of the halogen heaters 82*a* and 82*b* and the lateral end heaters 112*a* and 112*b* through the triacs 121*a* and 121*b*. According to this exemplary embodiment, in the secondary control mode, the triac 121*b* actuates the halogen heater 82*b* and the lateral end heaters 112*a* and 112*b* concurrently, simplifying control of the halogen heater 82*b* and the lateral end heaters 112*a* and 112*b*.

Figure 11:
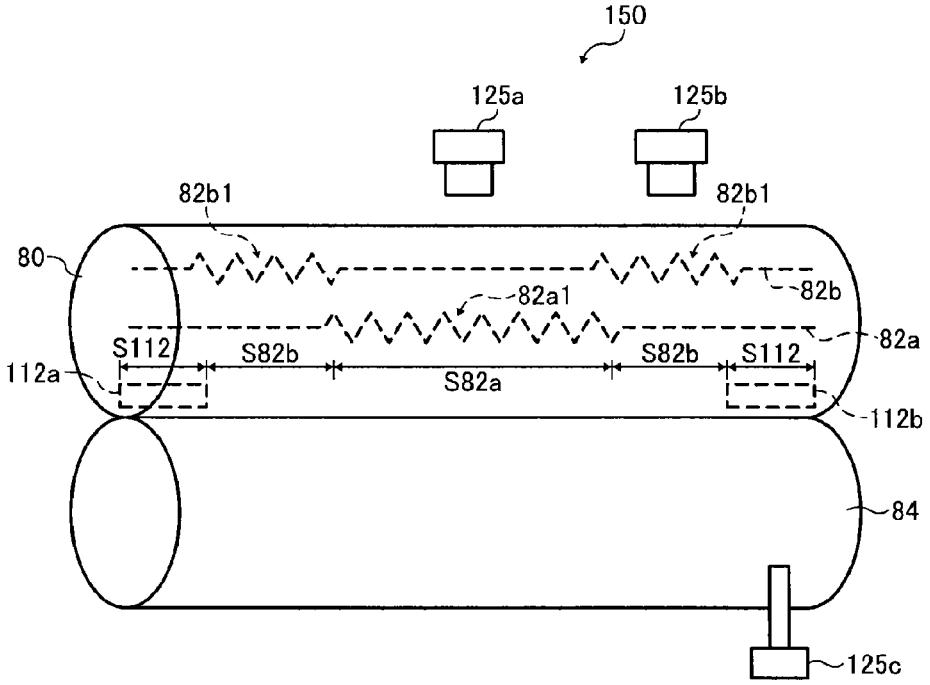
FIG. 11 is a perspective view of the fixing device illustrated in FIG. 2.

FIG. 11 is a perspective view of the fixing device 150. As illustrated in FIG. 11, a thermopile 125*a* serving as a primary temperature detector is adjacent to or in proximity to an outer circumferential surface of the fixing belt 80. The thermopile 125*a* is disposed opposite a heat generator 82*a*1 of the halogen heater 82*a* that spans the primary heating span S82*a*. A thermopile 125*b* serving as a secondary temperature detector is adjacent to or in proximity to the outer circumferential surface of the fixing belt 80. The thermopile 125*b* is disposed opposite a heat generator 82*b*1 of the halogen heater 82*b* that spans the secondary heating span S82*b*. A thermistor 125*c* serving as a tertiary temperature detector is in contact with an outer circumferential surface of the pressure roller 84. The thermistor 125*c* is disposed opposite one of the lateral end heaters 112*a* and 112*b*, each of which spans the tertiary heating span S 112. According to this exemplary embodiment, the thermistor 125*c* is disposed opposite the lateral end heater 112*b*. Although the lateral end heaters 112*a* and 112*b* contact the fixing belt 80 directly, since the pressure roller 84 pressingly contacts the fixing belt 80 and therefore receives heat from the fixing belt 80, the controller 130 controls the lateral end heaters 112*a* and 112*b* based on the temperature of the pressure roller 84 that is detected by the thermistor 125*c*. Hence, the temperature of the fixing belt 80 that is detected by the thermopiles 125*a* and 125*b* and the temperature of the pressure roller 84 that is detected by the thermistor 125*c* are sent to the controller 130.

A description is provided of a configuration of the controller 130.

Figure 12:
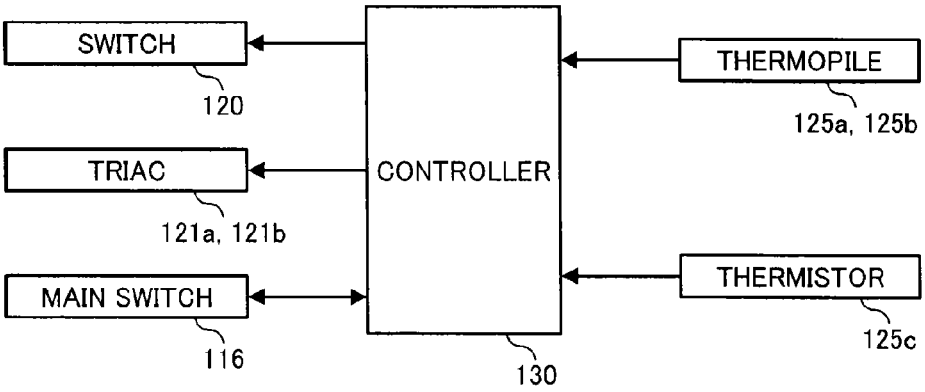
FIG. 12 is a block diagram of the control circuit illustrated in FIG. 10 and a controller to control the control circuit.

FIG. 12 is a block diagram of the controller 130 and the components of the control circuit 91 depicted in FIG. 10. The controller 130 (e.g., a processor) is a microcomputer including a central processing unit (CPU), a read-only memory (ROM), and a random-access memory (RAM) and is disposed inside a body of the image forming apparatus 100 depicted in FIG. 1. Alternatively, the controller 130 may be disposed inside the fixing device 150. As the main switch 116 depicted in FIG. 10 is turned on, the controller 130 causes the switch 120 to selectively contact the primary terminal T1 or the secondary terminal T2. The controller 130 controls the amount of power supplied to each of the halogen heaters 82*a* and 82*b* and the lateral end heaters 112*a* and 112*b* through the triacs 121*a* and 121*b* based on the temperature of the fixing belt 80 that is detected by the thermopiles 125*a* and 125*b* and the temperature of the pressure roller 84 that is detected by the thermistor 125*c*.

A detailed description is now given of a construction of the lateral end heaters 112*a* and 112*b*.

Figure 13:
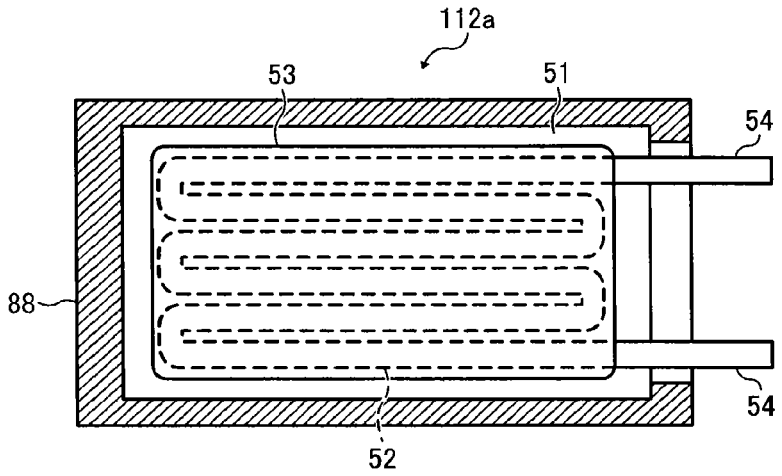
FIG. 13 is a plan view of the lateral end heater illustrated in FIG. 5.

FIG. 13 is a plan view of the lateral end heater 112*a*. Since the lateral end heaters 112*a* and 112*b* have an identical construction, FIG. 13 illustrates the lateral end heater 112*a*. The lateral end heater 112*a* includes a ceramic base 51, a resistive heat generator 52 layered on the ceramic base 51 with patterning, and an insulative layer 53 layered on the resistive heat generator 52. The ceramic base 51 has an outer size defined by a vertical length of about 10 mm and a horizontal length of about 20 mm in FIG. 13. The resistive heat generator 52 is a heat generator. The insulative layer 53 is a thin glass layer. Terminals 54, disposed at one lateral end of the lateral end heater 112*a* in the axial direction of the fixing belt 80, are connected to a power supply (e.g., the power supply 115) and a switching element (e.g., the triacs 121*a* and 121*b*).

As described above, the resistive heat generator 52 is mounted on a first face of the respective lateral end heaters 112*a* and 112*b* so that the first face of the respective lateral end heaters 112*a* and 112*b* that mounts the resistive heat generator 52 generates heat mainly while a second face of the respective lateral end heaters 112*a* and 112*b* that does not mount the resistive heat generator 52 barely receives heat from the first face. According to this exemplary embodiment, the first face of the respective lateral end heaters 112*a* and 112*b* that mounts the resistive heat generator 52 contacts the recesses 88*a* and 88*b* depicted in FIG. 6. The terminals 54 are mounted on the first face of the respective lateral end heaters 112*a* and 112*b*.

Figure 14:
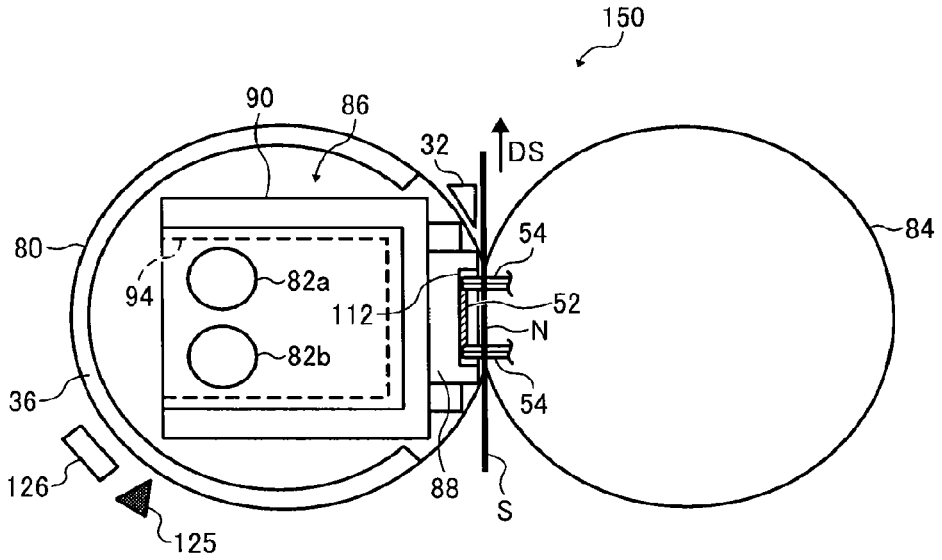
FIG. 14 is a schematic vertical cross-sectional view of the fixing device depicted in FIG. 2 illustrating the lateral end heater.

FIG. 14 is a schematic vertical cross-sectional view of the fixing device 150 illustrating the lateral end heater 112 representing the lateral end heaters 112*a* and 112*b*. As illustrated in FIG. 14, the first face of the respective lateral end heaters 112*a* and 112*b* that mounts the resistive heat generator 52 is isolated from the fixing belt 80. Accordingly, even if the insulative layer 53 depicted in FIG. 13 is broken, power supplied to the lateral end heaters 112*a* and 112*b* is not transmitted to the fixing belt 80.

Figure 15A:
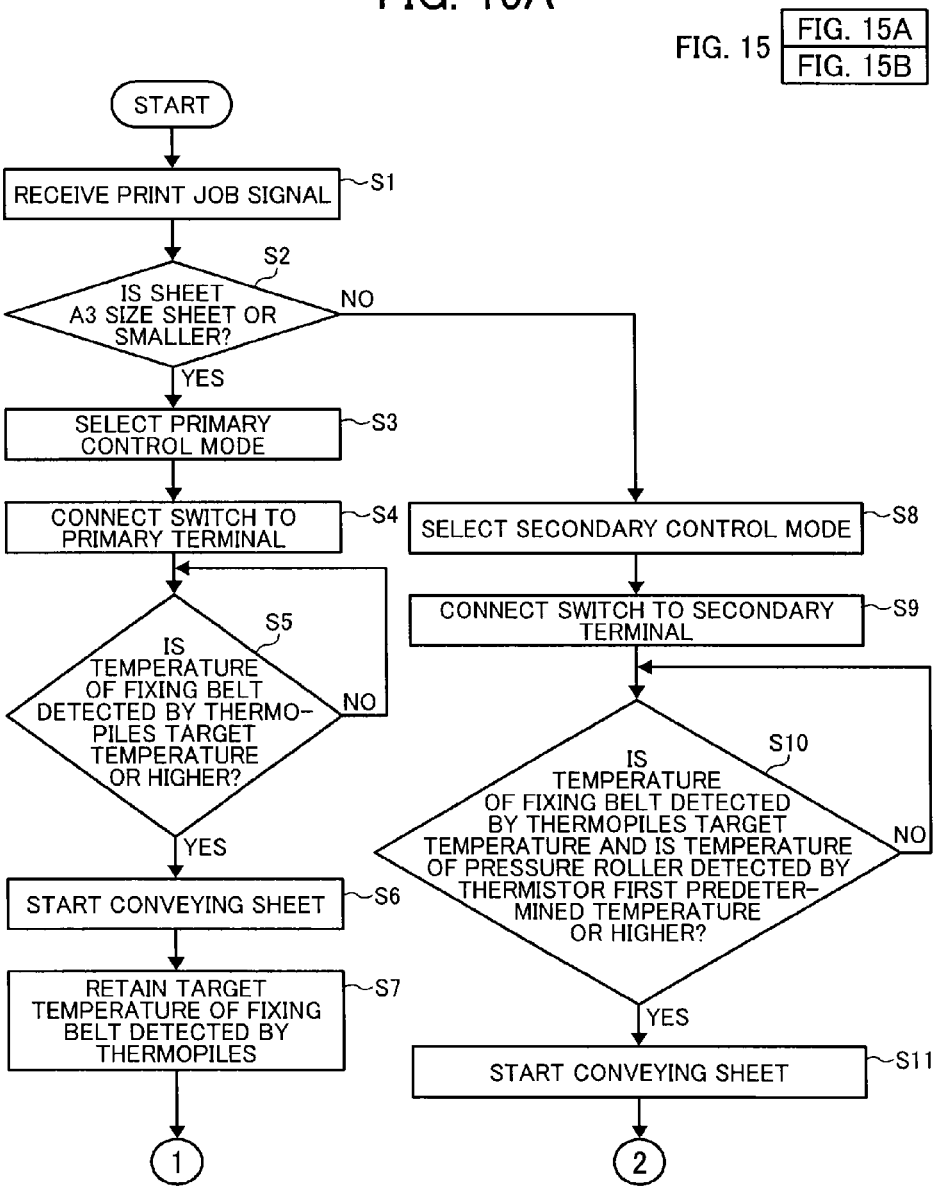
FIGS. 15A and 15B is a flowchart illustrating processes of a fixing control performed by the controller illustrated in FIG. 12.
Figure 15B:
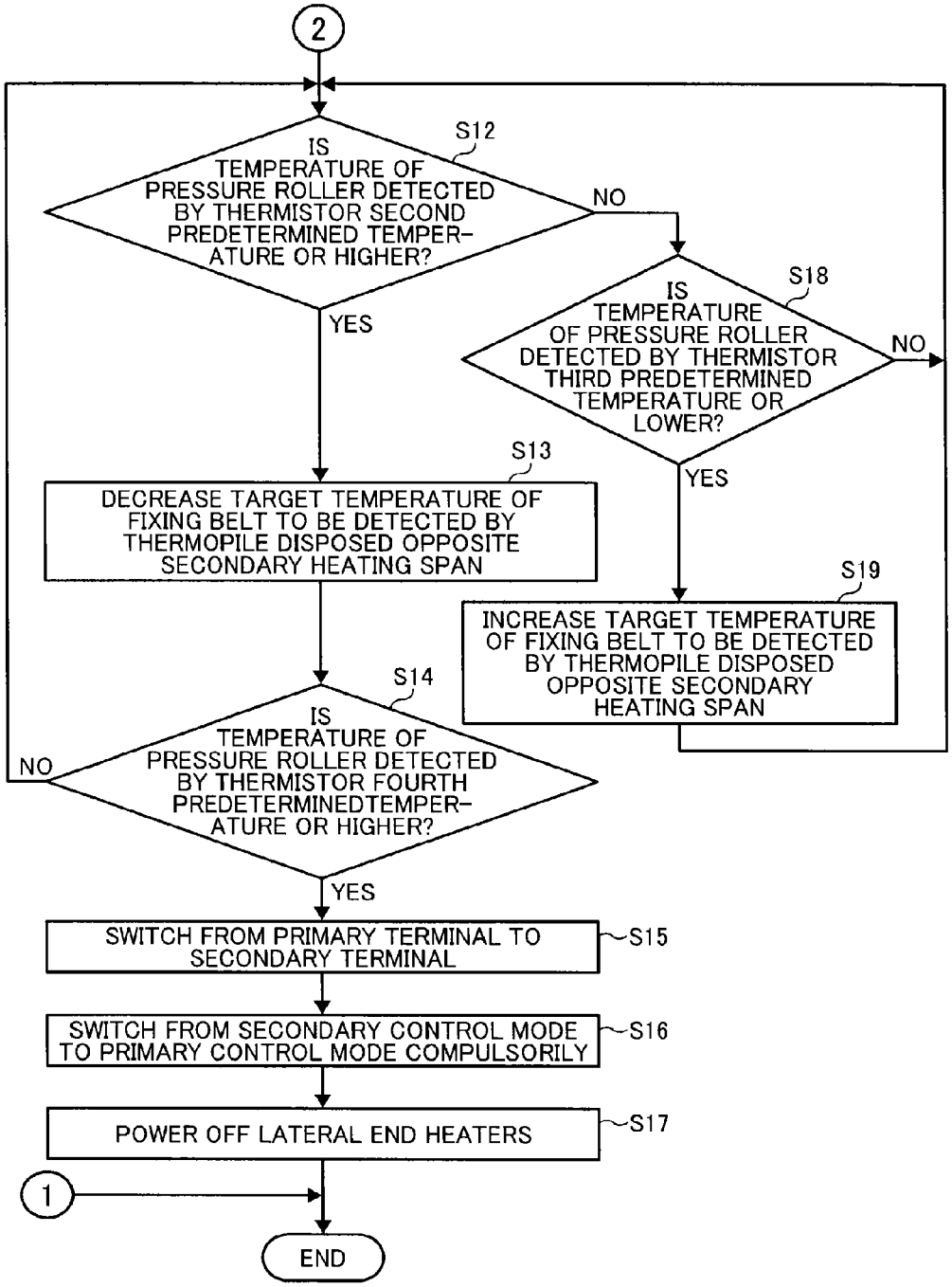
Figure 16:
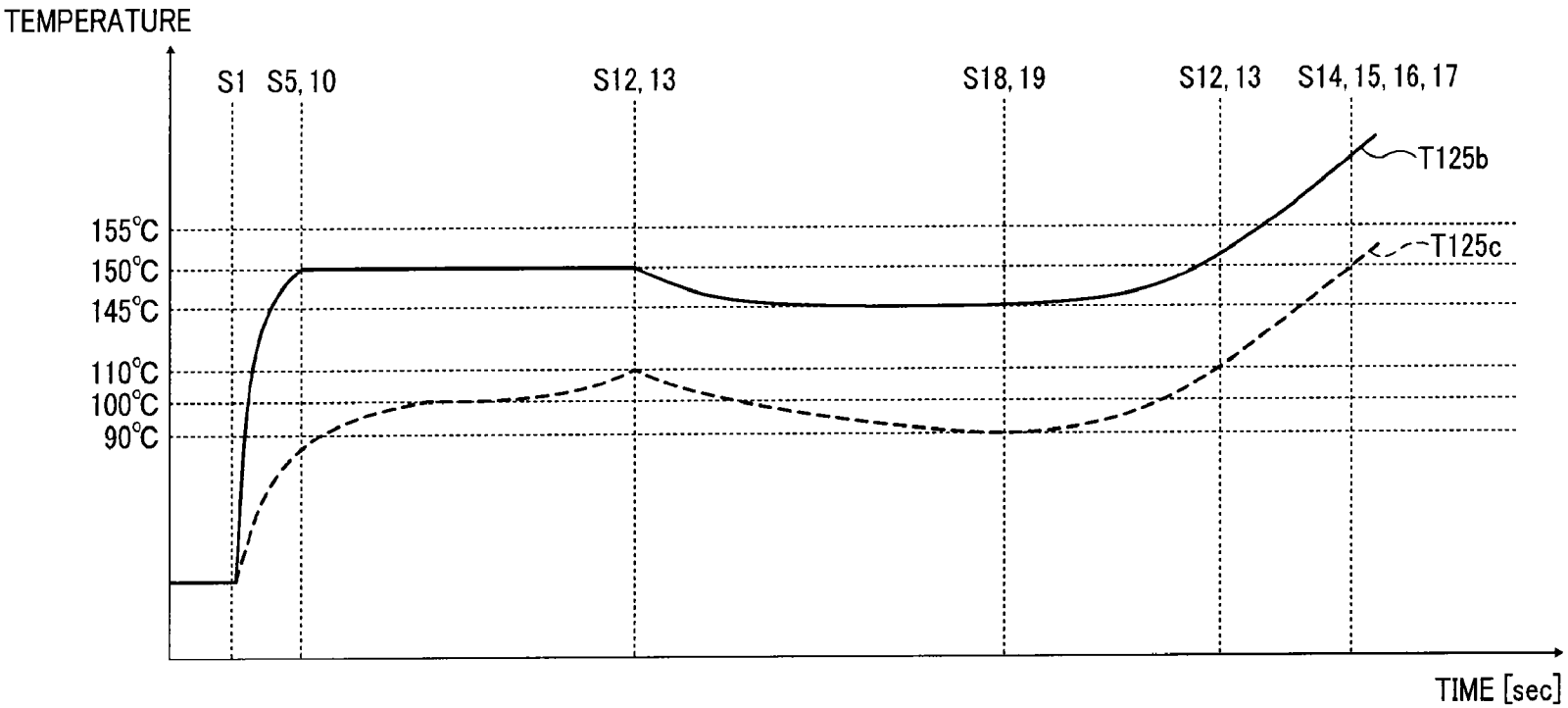
FIG. 16 is a graph illustrating the processes of the fixing control depicted in FIG. 15.

Referring to FIGS. 15 and 16, a description is provided of a fixing control performed by the fixing device 150.

FIG. 15 divided into FIGS. 15A and 15B is a flowchart illustrating processes of the fixing control performed by the fixing device 150.

In step S1, the controller 130 depicted in FIG. 12 receives a print job signal. In step S2, the controller 130 determines whether or not the print job signal indicates that a sheet S is the A3 size sheet or smaller. If the controller 130 determines that the print job signal indicates that the sheet S is the A3 size sheet or smaller (YES in step S2), the controller 130 selects the primary control mode in step S3. In step S4, the controller 130 connects the switch 120 depicted in FIG. 10 to the primary terminal T1.

In step S5, the controller 130 determines whether or not the temperature of the fixing belt 80 that is detected by the thermopiles 125*a* and 125*b* reaches a target temperature (e.g., 150 degrees centigrade). If the controller 130 determines that the detected temperature of the fixing belt 80 reaches the target temperature (YES in step S5), the controller 130 starts conveyance of the sheet S to the fixing nip N in step S6. As one example, the controller 130 causes the registration roller pair 4 depicted in FIG. 1 to convey the sheet S to the fixing device 150. After conveyance of the sheet S, the controller 130 controls the triacs 121*a* and 121*b* to adjust an amount of power supplied to the halogen heaters 82*a* and 82*b* so that the temperature of the fixing belt 80 detected by the thermopiles 125*a* and 125*b* retains the target temperature in step S7.

If the controller 130 determines that the print job signal indicates that the sheet S is greater than the A3 size sheet, for example, the A3 extension size sheet and the 13-inch sheet (NO in step S2), the controller 130 selects the secondary control mode in step S8. In step S9, the controller 130 connects the switch 120 to the secondary terminal T2. In step S 10, the controller 130 determines whether or not the temperature of the fixing belt 80 that is detected by the thermopiles 125*a* and 125*b* reaches the target temperature at which conveyance of the sheet S starts and whether or not the temperature of the pressure roller 84 that is detected by the thermistor 125*c* is a first predetermined temperature (e.g., 100 degrees centigrade) or higher. If the controller 130 determines that the detected temperature of the fixing belt 80 reaches the target temperature and the detected temperature of the pressure roller 84 is the first predetermined temperature or higher (YES in step S 10), the controller 130 starts conveyance of the sheet S to the fixing nip N in step S11.

After conveyance of the sheet S, the controller 130 determines whether or not the temperature of the pressure roller 84 that is detected by the thermistor 125*c* reaches a second predetermined temperature (e.g., 110 degrees centigrade) higher than the first predetermined temperature in step S12. If the controller 130 determines that the detected temperature of the pressure roller 84 reaches the second predetermined temperature (YES in step S12), the controller 130 decreases the target temperature of the fixing belt 80 to be detected by the thermopile 125*b* to 145 degrees centigrade, for example, in step S13. The controller 130 determines whether or not the temperature of the pressure roller 84 that is detected by the thermistor 125*c* reaches a fourth predetermined temperature (e.g., 150 degrees centigrade) higher than the second predetermined temperature in step S14. If the controller 130 determines that the detected temperature of the pressure roller 84 reaches the fourth predetermined temperature (YES in step S14), the controller 130 automatically switches connection of the switch 120 from the primary terminal T1 to the secondary terminal T2, that is, the controller 130 connects the switch 120 to the secondary terminal T2, in step S15. Thus, the controller 130 switches from the secondary control mode to the primary control mode compulsorily in step S16. In step S17, the controller 130 de-energizes or powers off the lateral end heaters 112*a* and 112*b*.

If the controller 130 determines that the detected temperature of the pressure roller 84 is lower than the second predetermined temperature (NO in step S12), the controller 130 determines whether or not the temperature of the pressure roller 84 detected by the thermistor 125*c* is a third predetermined temperature (e.g., 90 degrees centigrade) lower than the first predetermined temperature or lower in step S18. If the controller 130 determines that the detected temperature of the pressure roller 84 is the third predetermined temperature or lower (YES in step S18), the controller 130 increases the target temperature of the fixing belt 80 to be detected by the thermopile 125*b* to 155 degrees centigrade, for example, in step S19. Thereafter, the controller 130 returns to step S12.

Accordingly, even if a difference occurs between the temperature of the heating span S82 of the fixing belt 80 that is heated by the halogen heaters 82*a* and 82*b* and the temperature of the tertiary heating span S112 of the fixing belt 80 that is heated by the lateral end heaters 112*a* and 112*b*, the controller 130 starts conveying the sheet S to the fixing nip N after the temperature of the tertiary heating span S112 of the pressure roller 84 that is detected by the thermistor 125*c* is the predetermined temperature or higher, thus preventing formation of a faulty toner image. Additionally, even if the temperature of the tertiary heating span S112 of the fixing belt 80 that is heated by the respective lateral end heaters 112*a* and 112*b* fluctuates relative to the predetermined temperature in the print job, the controller 130 increases or decreases the target temperature of the heating span S82 of the fixing belt 80 that is heated by the halogen heaters 82*a* and 82*b*, thus preventing formation of a faulty toner image. Further, if the temperature of the tertiary heating span S112 of the fixing belt 80 that is heated by the respective lateral end heaters 112*a* and 112*b* increases excessively, the controller 130 switches from the secondary control mode to the primary control mode compulsorily, preventing various failures caused by overheating or temperature increase of the fixing belt 80 heated by the lateral end heaters 112*a* and 112*b* precisely.

FIG. 16 is a graph illustrating the processes described above (e.g., steps S1, S5, S10, S12, S13, S14, S15, S16, S17, S18, and S19) to control the temperatures of the fixing belt 80 and the pressure roller 84 detected by the thermopile 125*b* and the thermistor 125*c*, respectively. In FIG. 16, a curve T125*b* in a solid line represents the temperature of the fixing belt 80 detected by the thermopile 125*b*. A curve T125*c* in a dotted line represents the temperature of the pressure roller 84 detected by the thermistor 125*c*.

Under the fixing control described above, when the large sheet S is conveyed through the fixing device 150, the controller 130 connects the halogen heaters 82*a* and 82*b* to the lateral end heaters 112*a* and 112*b* in series to control the halogen heaters 82*a* and 82*b* and the lateral end heaters 112*a* and 112*b* concurrently with the simple control circuit 91 and the simple temperature sensors, that is, the thermopiles 125*a* and 125*b* and the thermistor 125*c*. The thermistor 125*c* is disposed opposite one of the lateral end heaters 112*a* and 112*b* to monitor the lateral end heaters 112*a* and 112*b* supplementarily, preventing formation of a faulty toner image and overheating of the fixing belt 80 precisely. The thermistor 125*c* that detects the temperature of the pressure roller 84 contacts the outer circumferential surface of the pressure roller 84 and does not contact the fixing belt 80. Accordingly, the thermistor 125*c* does not damage the fixing belt 80, preventing the fixing belt 80 from damaging the unfixed toner image on the sheet S at reduced manufacturing costs. Additionally, the thermistor 125*c* may be used in the primary control mode for other purposes, for example, to adjust an amount of heat stored in the fixing belt 80.

A description is provided of a configuration to detect failure.

As illustrated in FIG. 2, a safety device such as a thermostat 126 is disposed opposite and adjacent to or in proximity to the outer circumferential surface of the fixing belt 80 to prevent the thermopiles 125*a* and 125*b* illustrated as a thermopile 125 in FIG. 2 from being out of control when the thermopiles 125*a* and 125*b* suffer from failure. In the secondary control mode, the lateral end heaters 112*a* and 112*b* are energized concurrently with energization of the halogen heater 82*b*. To address this circumstance, the thermostat 126 is disposed in proximity to the halogen heater 82*b* and disposed opposite and in proximity to the outer circumferential surface of the fixing belt 80 to detect failure of the lateral end heaters 112*a* and 112*b* concurrently with detection of failure of the thermopiles 125*a* and 125*b*, thus simplifying the safety device.

Figure 17:
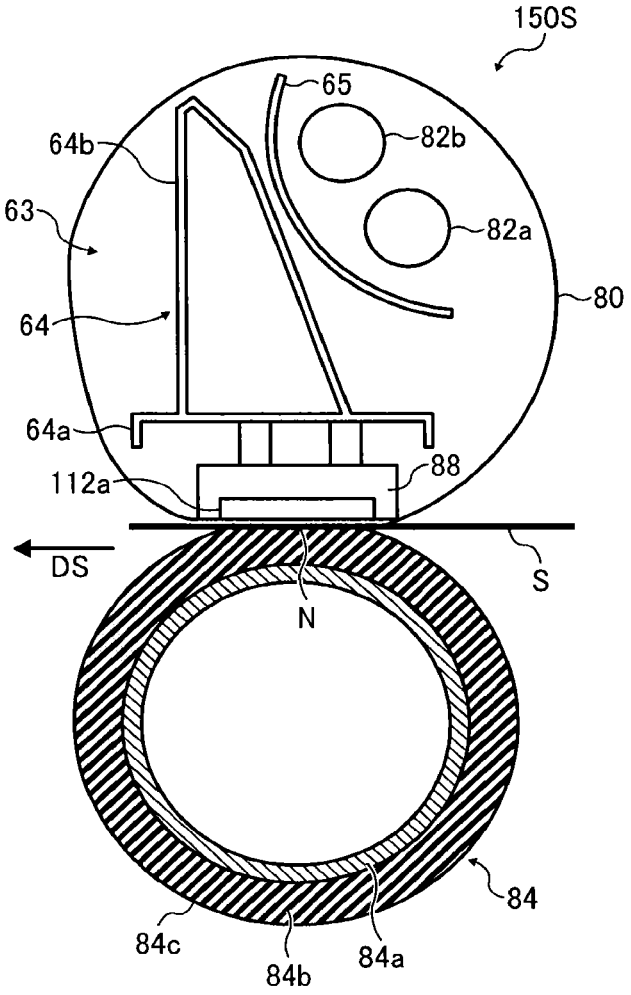
FIG. 17 is a schematic vertical cross-sectional view of a fixing device according to a second exemplary embodiment of the present disclosure.

Referring to FIG. 17, a description is provided of a construction of a nip formation assembly 63 (e.g., a nip formation unit) as a variation of the nip formation assembly 86 depicted in FIG. 2.

FIG. 17 is a schematic vertical cross-sectional view of a fixing device 150S (a fuser or a fusing unit) incorporating the nip formation assembly 63. As illustrated in FIG. 17, the nip formation assembly 63 includes the nip formation pad 88, the lateral end heaters 112*a* and 112*b*, and a stay 64 that supports the nip formation pad 88 against pressure from the pressure roller 84. The stay 64 includes a base 64*a* and a stand 64*b* coupled with the base 64*a*. The base 64*a* supports the nip formation pad 88 like the stay 90 depicted in FIG. 2. The stand 64*b* is contoured substantially into a triangle in cross-section. The halogen heaters 82*a* and 82*b* serving as a primary heater are interposed between the stand 64*b* of the stay 64 and the fixing belt 80. The halogen heaters 82*a* and 82*b* serving as a primary heater and a secondary heater, respectively, heat the fixing belt 80 directly with light irradiating the inner circumferential surface of the fixing belt 80, thus heating the fixing belt 80 with radiation heat. An arcuate, platy reflector 65 is interposed between the halogen heaters 82*a* and 82*b* and the stand 64*b* of the stay 64 to reflect light radiated from the halogen heaters 82*a* and 82*b* toward the fixing belt 80 so as to improve heating efficiency of the halogen heaters 82*a* and 82*b* to heat the fixing belt 80.

The nip formation assembly 63 achieves advantages similar to those of the nip formation assembly 86 described above. Alternatively, instead of the reflector 65, an exterior surface of the stand 64*b* may be treated with insulation or mirror finish to reflect light radiated from the halogen heaters 82*a* and 82*b* toward the fixing belt 80. In this case, the halogen heaters 82*a* and 82*b* heat the fixing belt 80 with a slightly decreased heating efficiency compared to a heating efficiency with which the halogen heaters 82*a* and 82*b* heat the fixing belt 80 together with the reflector 65.

The present disclosure is not limited to the details of the exemplary embodiments described above and various modifications and improvements are possible. The advantages achieved by the exemplary embodiments described above are examples and therefore are not limited to those described above.

A description is provided of advantages of the fixing devices 150 and 150S.

As illustrated in FIGS. 2 and 17, a fixing device (e.g., the fixing devices 150 and 150S) includes a flexible, endless belt (e.g., the fixing belt 80) serving as a fixing rotator rotatable in a predetermined direction of rotation (e.g., the rotation direction D80); a pressure rotator (e.g., the pressure roller 84) disposed opposite the endless belt; and a nip formation pad (e.g., the nip formation pad 88) to press against the pressure rotator via the endless belt to form the fixing nip N between the endless belt and the pressure rotator, through which a recording medium (e.g., a sheet S) bearing a toner image is conveyed.

As illustrated in FIG. 11, the fixing device further includes a primary heater (e.g., the halogen heater 82*a*), a secondary heater (e.g., the halogen heater 82*b*), and a tertiary heater (e.g., the lateral end heaters 112*a* and 112*b*). The primary heater is disposed opposite the primary heating span S82*a* of the endless belt to heat the primary heating span S82*a* of the endless belt. The primary heating span S82*a* is a center span of the endless belt in an axial direction thereof. The secondary heater is disposed opposite the secondary heating span S82*b* of the endless belt to heat the secondary heating span S82*b* of the endless belt. The secondary heating span S82*b* is outboard from the primary heating span S82*a* in the axial direction of the endless belt. The tertiary heater is disposed opposite the tertiary heating span S112 of the endless belt to heat the tertiary heating span S112 of the endless belt. The tertiary heating span S112 is a lateral end span of the endless belt in the axial direction thereof and outboard from the secondary heating span S82*b* in the axial direction of the endless belt.

As illustrated in FIG. 10, a power supply (e.g., the power supply 115) is connected to the primary heater, the secondary heater, and the tertiary heater to energize each of the primary heater, the secondary heater, and the tertiary heater.

As illustrated in FIG. 11, the fixing device further includes a primary temperature detector (e.g., the thermopile 125*a*) disposed opposite the primary heating span S82*a* of the endless belt to detect a temperature of the primary heating span S82*a* of the endless belt; a secondary temperature detector (e.g., the thermopile 125*b*) disposed opposite the secondary heating span S82*b* of the endless belt to detect a temperature of the secondary heating span S82*b* of the endless belt; and a tertiary temperature detector (e.g., the thermistor 125*c*) disposed opposite the tertiary heating span S112 of the pressure rotator to detect a temperature of the tertiary heating span S112 of the pressure rotator.

As illustrated in FIG. 12, the fixing device further includes a controller (e.g., the controller 130) to selectively perform the primary control mode to de-energize the tertiary heater and the secondary control mode to connect the secondary heater and the tertiary heater in series to energize the primary heater, the secondary heater, and the tertiary heater. The controller energizes the secondary heater and the tertiary heater in the secondary control mode based on a temperature of the endless belt and the pressure rotator detected by the secondary temperature detector and the tertiary temperature detector, respectively, by feedback control.

Accordingly, the controller connects the primary heater, the secondary heater, and the tertiary heater in series to control the primary heater, the secondary heater, and the tertiary heater concurrently when a large recording medium is conveyed through the fixing device, thus simplifying the control circuit 91 depicted in FIG. 10 and temperature sensors (e.g., the thermopiles 125*a* and 125*b* and the thermistor 125*c*). The tertiary temperature detector is disposed opposite the tertiary heater to monitor the tertiary heater supplementarily, preventing formation of a faulty toner image and overheating of the endless belt precisely.

Further, the controller controls the temperature of the endless belt precisely, preventing formation of a faulty toner image and failure caused by overheating of the endless belt.

As illustrated in FIG. 11, the fixing device 150 employs a center conveyance system in which the sheet S is centered on the fixing belt 80 in the axial direction thereof. Accordingly, the halogen heater 82*a* is disposed opposite the primary heating span S82*a*, that is, the center span of the fixing belt 80 in the axial direction thereof. The heat generator 82*b*1 of the halogen heater 82*b* is disposed opposite the secondary heating span S82*b*, that is, each lateral end span of the fixing belt 80 in the axial direction thereof. Each of the lateral end heaters 112*a* and 112*b* is disposed opposite the tertiary heating span S112, that is, each lateral end span of the fixing belt 80 that is outboard from the secondary heating span S82*b* in the axial direction of the fixing belt 80. Alternatively, the fixing device 150 may employ a lateral end conveyance system in which the sheet S is conveyed in the sheet conveyance direction DS along one lateral end of the fixing belt 80 in the axial direction thereof. In this case, one of the heat generators 82*b*1 of the halogen heater 82*b* and one of the lateral end heaters 112*a* and 112*b* are eliminated. Another one of the heat generators 82*b*1 of the halogen heater 82*b* and another one of the lateral end heaters 112*a* and 112*b* are distal from the lateral end of the fixing belt 80 in the axial direction thereof.

According to the exemplary embodiments described above, the fixing belt 80 serves as a fixing rotator. Alternatively, a fixing roller, a fixing film, a fixing sleeve, or the like may be used as a fixing rotator. Further, the pressure roller 84 serves as a pressure rotator. Alternatively, a pressure belt or the like may be used as a pressure rotator.

The present disclosure has been described above with reference to specific exemplary embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative exemplary embodiments may e combined with each other and/or substituted for each other within the scope of the present disclosure.

What is claimed is:

1. A fixing device comprising:

a fixing rotator rotatable in a predetermined direction of rotation;

a pressure rotator to press against the fixing rotator to form a fixing nip between the fixing rotator and the pressure rotator, the fixing nip through which a recording medium bearing a toner image is conveyed;

a primary heater disposed opposite a primary heating span of the fixing rotator to heat the primary heating span of the fixing rotator;

a secondary heater disposed opposite a secondary heating span of the fixing rotator to heat the secondary heating span of the fixing rotator, the secondary heating span being outboard from the primary heating span in an axial direction of the fixing rotator;

a tertiary heater disposed opposite a tertiary heating span of the fixing rotator to heat the tertiary heating span of the fixing rotator, the tertiary heating span being outboard from the secondary heating span in the axial direction of the fixing rotator;

a primary temperature detector disposed opposite the primary heating span of the fixing rotator to detect a temperature of the primary heating span of the fixing rotator;

a secondary temperature detector disposed opposite the secondary heating span of the fixing rotator to detect a temperature of the secondary heating span of the fixing rotator;

a tertiary temperature detector disposed opposite a tertiary heating span of the pressure rotator which corresponds to the tertiary heating span of the fixing rotator, the tertiary temperature detector to detect a temperature of the tertiary heating span of the pressure rotator; and a controller to selectively perform a primary control mode to de-energize the tertiary heater and a secondary control mode to connect the secondary heater and the tertiary heater in series to energize the primary heater, the secondary heater, and the tertiary heater, the controller to energize the secondary heater and the tertiary heater in the secondary control mode based on the temperature of the fixing rotator and the pressure rotator detected by the secondary temperature detector and the tertiary temperature detector, respectively.

2. The fixing device according to claim 1, wherein the tertiary temperature detector contacts the pressure rotator.

3. The fixing device according to claim 1, wherein the controller starts conveying the recording medium to the fixing nip when the temperature of the pressure rotator detected by the tertiary temperature detector is a first predetermined temperature or higher in the secondary control mode.

4. The fixing device according to claim 3, wherein the controller decreases a target temperature of the secondary heating span of the fixing rotator to be detected by the secondary temperature detector when the temperature of the pressure rotator detected by the tertiary temperature detector reaches a second predetermined temperature higher than the first predetermined temperature after conveyance of the recording medium.

5. The fixing device according to claim 4, wherein the controller increases the target temperature of the secondary heating span of the fixing rotator to be detected by the secondary temperature detector when the temperature of the pressure rotator detected by the tertiary temperature detector reaches a third predetermined temperature lower than the first predetermined temperature after conveyance of the recording medium.

6. The fixing device according to claim 5, wherein the controller switches from the secondary control mode to the primary control mode when the temperature of the tertiary heating span of the pressure rotator detected by the tertiary temperature detector reaches a fourth predetermined temperature higher than the second predetermined temperature after conveyance of the recording medium.

7. The fixing device according to claim 1, wherein the controller selects the primary control mode when the recording medium has a width not greater than a predetermined width in the axial direction of the fixing rotator, and wherein the controller selects the secondary control mode when the recording medium has a width greater than the predetermined width in the axial direction of the fixing rotator.

8. The fixing device according to claim 7, wherein the recording medium having the predetermined width is used frequently.

9. The fixing device according to claim 7, wherein the recording medium having the predetermined width is conveyed over the primary heating span and the secondary heating span of the fixing rotator.

10. The fixing device according to claim 1, wherein each of the primary temperature detector and the secondary temperature detector includes a thermopile and the tertiary temperature detector includes a thermistor.

11. The fixing device according to claim 10, further comprising a thermostat disposed opposite the fixing rotator to detect failure of the tertiary temperature detector.

12. The fixing device according to claim 1, wherein the fixing rotator includes a flexible endless belt.

13. The fixing device according to claim 12, further comprising a nip formation pad to press against the pressure rotator via the endless belt to form the fixing nip.

14. The fixing device according to claim 1, further comprising a primary triac connected to the primary heater to energize the primary heater in the primary control mode and the secondary control mode.

15. The fixing device according to claim 14, further comprising:

a primary terminal connected to the secondary heater;

a secondary terminal connected to the secondary heater and the tertiary heater;

a switch to contact the primary terminal to energize the secondary heater and contact the secondary terminal to energize the secondary heater and the tertiary heater; and a secondary triac connected to the switch.

16. The fixing device according to claim 15, wherein the switch contacts the primary terminal to energize the secondary heater in the primary control mode.

17. The fixing device according to claim 16, wherein the switch contacts the secondary terminal to energize the secondary heater and the tertiary heater in the secondary control mode.

18. An image forming apparatus comprising:

an image bearer to bear a toner image;

a fixing rotator disposed downstream from the image bearer in a recording medium conveyance direction and rotatable in a predetermined direction of rotation;

a pressure rotator to press against the fixing rotator to form a fixing nip between the fixing rotator and the pressure rotator, the fixing nip through which a recording medium bearing the toner image is conveyed;

a primary heater disposed opposite a primary heating span of the fixing rotator to heat the primary heating span of the fixing rotator;

a secondary heater disposed opposite a secondary heating span of the fixing rotator to heat the secondary heating span of the fixing rotator, the secondary heating span being outboard from the primary heating span in an axial direction of the fixing rotator;

a tertiary heater disposed opposite a tertiary heating span of the fixing rotator to heat the tertiary heating span of the fixing rotator, the tertiary heating span being outboard from the secondary heating span in the axial direction of the fixing rotator;

a power supply to supply power to the primary heater, the secondary heater, and the tertiary heater;

a primary temperature detector disposed opposite the primary heating span of the fixing rotator to detect a temperature of the primary heating span of the fixing rotator;

a secondary temperature detector disposed opposite the secondary heating span of the fixing rotator to detect a temperature of the secondary heating span of the fixing rotator;

a tertiary temperature detector disposed opposite a tertiary heating span of the pressure rotator which corresponds to the tertiary heating span of the fixing rotator, the tertiary temperature detector to detect a temperature of the tertiary heating span of the pressure rotator; and a controller to selectively perform a primary control mode to de-energize the tertiary heater and a secondary control mode to connect the secondary heater and the tertiary heater in series to energize the primary heater, the secondary heater, and the tertiary heater, the controller to energize the secondary heater and the tertiary heater in the secondary control mode based on the temperature of the fixing rotator and the pressure rotator detected by the secondary temperature detector and the tertiary temperature detector, respectively.

19. A fixing method comprising:

determining that a recording medium has a predetermined size or greater;

energizing a primary heater, a secondary heater, and a tertiary heater to heat a primary heating span, a secondary heating span, and a tertiary heating span of a fixing rotator, respectively;

determining that a temperature of the primary heating span and the secondary heating span of the fixing rotator reaches a target temperature and a temperature of the tertiary heating span of a pressure rotator is a first predetermined temperature or higher;

starting conveying the recording medium to the fixing rotator;

determining that a temperature of the tertiary heating span of the pressure rotator which corresponds to the tertiary heating span of the fixing member rotator is lower than a second predetermined temperature;

determining that the temperature of the tertiary heating span of the pressure rotator is a third predetermined temperature or lower; and increasing the target temperature.

20. The fixing method according to claim 19, further comprising:

determining that the temperature of the tertiary heating span of the pressure rotator is the second predetermined temperature or higher;

decreasing the target temperature;

determining that the temperature of the tertiary heating span of the pressure rotator is a fourth predetermined temperature or higher; and de-energizing the tertiary heater.

* * * * *